US006332064B1

(12) United States Patent
Sato et al.

(10) Patent No.: US 6,332,064 B1
(45) Date of Patent: Dec. 18, 2001

(54) IMAGE FORMING APPARATUS INCLUDING A CHARGING POWER SUPPLY AND A NEUTRALIZING DEVICE

(75) Inventors: Hiroaki Sato; Kenichi Ashida; Kimihide Ishizaki; Koji Ida, all of Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/347,063

(22) Filed: Jul. 2, 1999

(30) Foreign Application Priority Data

Jul. 6, 1998 (JP) ..... 10/190364
Mar. 31, 1999 (JP) ..... 11/091885

(51) Int. Cl.[7] ..... G03G 15/02; G03G 15/16; G03G 21/00

(52) U.S. Cl. ..... 399/50; 399/128

(58) Field of Search ..... 399/50, 51, 177, 399/128, 186, 191, 4, 173, 176

(56) References Cited

U.S. PATENT DOCUMENTS 4,046,471 * 9/1977 Branham et al. ..... 399/4
4,474,455 * 10/1984 Hirakura et al. ..... 399/128
4,533,230 * 8/1985 Fletcher et al. ..... 399/173
4,640,599 * 2/1987 Doutney ..... 399/128
4,785,324 * 11/1988 Yamazaki et al. ..... 399/128
5,303,009 * 4/1994 Nishizawa ..... 399/71
5,450,180 * 9/1995 Ohzeki et al. ..... 399/50
5,701,551 * 12/1997 Honda et al. ..... 399/50
5,771,422 * 6/1998 Morihara ..... 399/50
5,797,064 * 8/1998 Raj et al. ..... 399/51 X
5,812,905 * 9/1998 Yoo ..... 399/50
5,887,220 * 3/1999 Nagaoka ..... 399/50 X
5,970,302 * 10/1999 Yamane ..... 399/50 X
5,974,277 * 10/1999 Yamane et al. ..... 399/50

FOREIGN PATENT DOCUMENTS 55-111967 * 8/1980 (JP) .
60-147756 8/1985 (JP) .
63-208878 8/1988 (JP) .
1-309076 12/1989 (JP) .
2-264974 10/1990 (JP) .

* cited by examiner

*Primary Examiner*—Fred L Braun
(74) *Attorney, Agent, or Firm*—Akin, Gump, Strauss, Hauer & Feld, L.L.P.

(57) ABSTRACT

An electrophotographic image forming apparatus in which an electrostatic latent image is formed on a charged surface of a photoconductive drum. The image is developed with toner into a toner image and the toner image is transferred to a recording medium. A charging roller is in contact with the photoconductive drum and charges the photoconductive drum when the charging roller receives a high voltage. A detector detects a characteristic such as an electrical resistance of the charging roller and outputs a signal indicative of the characteristic. A charging power supply applies a high voltage to the charging roller, the voltage having a value in accordance with the signal. A neutralizing device neutralizes the charged surface of the photoconductive drum before the detector detects the characteristic of the charging roller but does not neutralize the charged surface of the photoconductive drum when the electrostatic latent image is being formed.

20 Claims, 33 Drawing Sheets

MAIN CONTROLLER
130
CHARGING POWER SUPPLY
116
CLEANING POWER SUPPLY
117
102
102a
102b
103
101
101a
101b
101c
A
119
115
104
105
105a
106
109
108
107
110
111
112
113
114
118
TRANSFER POWER SUPPLY

FIG.4A

TABLE 1

| RECORDING SPEED [mm/sec] | RESISTANCE [Ω] | | | | |
|---|---|---|---|---|---|
| | $5*10^4$ | $1*10^5$ | $5*10^5$ | $1*10^6$ | $5*10^6$ |
| 100 | × | ○ | ○ | ○ | × |
| 150 | × | ○ | ○ | ○ | × |
| 200 | × | ○ | ○ | × | × |
| 250 | × | ○ | ○ | × | × |

FIG.4B

TABLE 2

| RECORDING SPEED [mm/sec] | RESISTANCE [Ω] | | | | |
|---|---|---|---|---|---|
| | $5*10^4$ | $1*10^5$ | $5*10^5$ | $1*10^6$ | $5*10^6$ |
| 100 | × | × | ○ | ○ | ○ |
| 150 | × | × | ○ | ○ | ○ |
| 200 | × | × | ○ | ○ | × |
| 250 | × | × | ○ | ○ | × |

FIG.4C

TABLE 3

| RECORDING SPEED [mm/sec] | RESISTANCE [Ω] | | | | |
|---|---|---|---|---|---|
| | $5*10^4$ | $1*10^5$ | $5*10^5$ | $1*10^6$ | $5*10^6$ |
| 100 | ○ | ○ | ○ | × | × |
| 150 | ○ | ○ | ○ | × | × |
| 200 | ○ | ○ | × | × | × |
| 250 | ○ | ○ | × | × | × |

FIG.4D

TABLE 4

| RECORDING SPEED [mm/sec] | RESISTANCE [Ω] | | | | |
|---|---|---|---|---|---|
| | $5*10^4$ | $1*10^5$ | $5*10^5$ | $1*10^6$ | $5*10^6$ |
| 100 | × | ○ | ○ | ○ | ○ |
| 150 | × | ○ | ○ | ○ | ○ |
| 200 | × | ○ | ○ | ○ | ○ |
| 250 | × | ○ | ○ | ○ | ○ |

FIG.4E

TABLE 5

| RECORDING SPEED [mm/sec] | RESISTANCE [Ω] | | | | |
|---|---|---|---|---|---|
| | $5*10^4$ | $1*10^5$ | $5*10^5$ | $1*10^6$ | $5*10^6$ |
| 100 | × | × | ○ | ○ | ○ |
| 150 | × | × | ○ | ○ | ○ |
| 200 | × | × | ○ | ○ | ○ |
| 250 | × | × | ○ | ○ | ○ |

FIG.4F

TABLE 6

| RECORDING SPEED [mm/sec] | RESISTANCE [Ω] | | | | |
|---|---|---|---|---|---|
| | $5*10^4$ | $1*10^5$ | $5*10^5$ | $1*10^6$ | $5*10^6$ |
| 100 | ○ | ○ | ○ | ○ | ○ |
| 150 | ○ | ○ | ○ | ○ | ○ |
| 200 | ○ | ○ | ○ | ○ | ○ |
| 250 | ○ | ○ | ○ | ○ | ○ |

FIG.8A

TABLE 7

| RECORDING SPEED [mm/sec] | RESISTANCE [Ω] | | | | |
|---|---|---|---|---|---|
| | $5*10^4$ | $1*10^5$ | $5*10^5$ | $1*10^6$ | $5*10^6$ |
| 100 | × | ○ | ○ | ○ | ○ |
| 150 | × | ○ | ○ | ○ | ○ |
| 200 | × | ○ | ○ | ○ | ○ |
| 250 | × | ○ | ○ | ○ | ○ |

FIG.8B

TABLE 8

| RECORDING SPEED [mm/sec] | RESISTANCE [Ω] | | | | |
|---|---|---|---|---|---|
| | $5*10^4$ | $1*10^5$ | $5*10^5$ | $1*10^6$ | $5*10^6$ |
| 100 | × | × | ○ | ○ | ○ |
| 150 | × | × | ○ | ○ | ○ |
| 200 | × | × | ○ | ○ | ○ |
| 250 | × | × | ○ | ○ | ○ |

FIG.8C

TABLE 9

| RECORDING SPEED [mm/sec] | RESISTANCE [Ω] | | | | |
|---|---|---|---|---|---|
| | $5*10^4$ | $1*10^5$ | $5*10^5$ | $1*10^6$ | $5*10^6$ |
| 100 | ○ | ○ | ○ | ○ | ○ |
| 150 | ○ | ○ | ○ | ○ | ○ |
| 200 | ○ | ○ | ○ | ○ | ○ |
| 250 | ○ | ○ | ○ | ○ | ○ |

MAIN CONTROLLER
130
CHARGING POWER SUPPLY
116
NEUTRALIZING POWER SUPPLY
120
121
CLEANING POWER SUPPLY
117
TRANSFER POWER SUPPLY
118
102a
102b
102
101
103
104
105
106
107
108
109
110
111
112
113
114
115
119
A

FIG.10A

TABLE 10

| RECORDING SPEED [mm/sec] | RESISTANCE [Ω] | | | | |
|---|---|---|---|---|---|
| | $5*10^4$ | $1*10^5$ | $5*10^5$ | $1*10^6$ | $5*10^6$ |
| 100 | × | ○ | ○ | ○ | ○ |
| 150 | × | ○ | ○ | ○ | ○ |
| 200 | × | ○ | ○ | ○ | ○ |
| 250 | × | ○ | ○ | ○ | ○ |

FIG.10B

TABLE 11

| RECORDING SPEED [mm/sec] | RESISTANCE [Ω] | | | | |
|---|---|---|---|---|---|
| | $5*10^4$ | $1*10^5$ | $5*10^5$ | $1*10^6$ | $5*10^6$ |
| 100 | × | × | ○ | ○ | ○ |
| 150 | × | × | ○ | ○ | ○ |
| 200 | × | × | ○ | ○ | ○ |
| 250 | × | × | ○ | ○ | ○ |

FIG.10C

TABLE 12

| RECORDING SPEED [mm/sec] | RESISTANCE [Ω] | | | | |
|---|---|---|---|---|---|
| | $5*10^4$ | $1*10^5$ | $5*10^5$ | $1*10^6$ | $5*10^6$ |
| 100 | ○ | ○ | ○ | ○ | ○ |
| 150 | ○ | ○ | ○ | ○ | ○ |
| 200 | ○ | ○ | ○ | ○ | ○ |
| 250 | ○ | ○ | ○ | ○ | ○ |

FIG.12A

TABLE 13

| RECORDING SPEED [mm/sec] | RESISTANCE [Ω] | | | | |
|---|---|---|---|---|---|
| | $5*10^4$ | $1*10^5$ | $5*10^5$ | $1*10^6$ | $5*10^6$ |
| 100 | × | ○ | ○ | ○ | ○ |
| 150 | × | ○ | ○ | ○ | ○ |
| 200 | × | ○ | ○ | ○ | ○ |
| 250 | × | ○ | ○ | ○ | ○ |

FIG.12B

TABLE 14

| RECORDING SPEED [mm/sec] | RESISTANCE [Ω] | | | | |
|---|---|---|---|---|---|
| | $5*10^4$ | $1*10^5$ | $5*10^5$ | $1*10^6$ | $5*10^6$ |
| 100 | × | × | ○ | ○ | ○ |
| 150 | × | × | ○ | ○ | ○ |
| 200 | × | × | ○ | ○ | ○ |
| 250 | × | × | ○ | ○ | ○ |

FIG.12C

TABLE 15

| RECORDING SPEED [mm/sec] | RESISTANCE [Ω] | | | | |
|---|---|---|---|---|---|
| | $5*10^4$ | $1*10^5$ | $5*10^5$ | $1*10^6$ | $5*10^6$ |
| 100 | ○ | ○ | ○ | ○ | ○ |
| 150 | ○ | ○ | ○ | ○ | ○ |
| 200 | ○ | ○ | ○ | ○ | ○ |
| 250 | ○ | ○ | ○ | ○ | ○ |

OUTPUT VOLTAGES OF CHARGING POWER SUPPLY AND SUBSIDIARY CHARGING POWER SUPPLY FOR CHARGING PHOTOCONDUCTIVE DRUM TO -800V

OUTPUT VOLTAGES OF CHARGING POWER SUPPLY AND SUBSIDIARY CHARGING POWER SUPPLY FOR CHARGING PHOTOCONDUCTIVE DRUM TO -800V

FIG.25A

TABLE I

| | | | | | | | | | |
|---|---|---|---|---|---|---|---|---|---|
| CCC MODE | RANGE | 0 | 1 | 2 | 3 | 4 | 5 | 6 | 7 |
| | VOLTAGE (V) | 39.0625 | 117.188 | 195.313 | 273.438 | 361.563 | 429.688 | 507.813 | 585.938 |
| CVC MODE | VOLTAGE (V) | 742.93 | 762.48 | 782.031 | 801.582 | 821.133 | 840.684 | 860.234 | 879.785 |
| | RANGE | 25 | 26 | 27 | 28 | 29 | 2A | 2B | 2C |
| CCC MODE | RANGE | 8 | 9 | A | B | C | D | E | F |
| | VOLTAGE (V) | 664.063 | 742.188 | 820.313 | 898.438 | 976.563 | 1054.69 | 1132.81 | 1210.94 |
| CVC MODE | VOLTAGE (V) | 899.336 | 918.887 | 938.438 | 957.988 | 977.539 | 997.09 | 1016.64 | 1036.19 |
| | RANGE | 2D | 2E | 2F | 30 | 31 | 32 | 33 | 34 |

FIG.25B

TABLE II

| | | | | | | | | | |
|---|---|---|---|---|---|---|---|---|---|
| CCC MODE | RANGE | 10 | 11 | 12 | 13 | 14 | 15 | 16 | 17 |
| | VOLTAGE (V) | 1289.06 | 1367.19 | 1445.31 | 1523.44 | 1601.56 | 1679.69 | 1757.81 | 1835.94 |
| CVC MODE | VOLTAGE (V) | 1055.74 | 1075.29 | 1094.84 | 1114.39 | 1133.95 | 1153.5 | 1173.05 | 1192.6 |
| | RANGE | 35 | 36 | 37 | 38 | 39 | 3A | 3B | 3C |
| CCC MODE | RANGE | 18 | 19 | 1A | 1B | 1C | 1D | 1E | 1F |
| | VOLTAGE (V) | 1914.06 | 1992.19 | 2070.31 | 2148.44 | 2226.56 | 2304.69 | 2382.81 | 2460.94 |
| CVC MODE | VOLTAGE (V) | 1212.15 | 1231.7 | 1251.25 | 1270.8 | 1290.35 | 1309.9 | 1329.45 | 1349 |
| | RANGE | 3D | 3E | 3F | 40 | 41 | 42 | 43 | 44 |

FIG.25C

TABLE III

| | | | | | | | | | |
|---|---|---|---|---|---|---|---|---|---|
| CCC MODE | RANGE | 20 | 21 | 22 | 23 | 24 | 25 | 26 | 27 |
| | VOLTAGE (V) | 2539.06 | 2617.19 | 2695.31 | 2773.44 | 2851.56 | 2929.69 | 3007.81 | 3085.94 |
| CVC MODE | VOLTAGE (V) | 1368.55 | 1388.11 | 1407.66 | 1427.21 | 1446.76 | 1466.31 | 1485.46 | 1505.41 |
| | RANGE | 45 | 46 | 47 | 48 | 49 | 4A | 4B | 4C |

| | | | | | | | | | |
|---|---|---|---|---|---|---|---|---|---|
| CCC MODE | RANGE | 28 | 29 | 2A | 2B | 2C | 2D | 2E | 2F |
| | VOLTAGE (V) | 3164.06 | 3242.19 | 3320.31 | 3398.44 | 3476.56 | 3554.69 | 3632.81 | 3710.94 |
| CVC MODE | VOLTAGE (V) | 1524.96 | 1544.51 | 1564.06 | 1583.61 | 1603.16 | 1622.71 | 1642.27 | 1661.82 |
| | RANGE | 4D | 4E | 4F | 50 | 51 | 52 | 53 | 54 |

FIG.25D

TABLE IV

| | | | | | | | | | |
|---|---|---|---|---|---|---|---|---|---|
| CCC MODE | RANGE | 30 | 31 | 32 | 33 | 34 | 35 | 36 | 37 |
| | VOLTAGE (V) | 3789.06 | 3867.19 | 3945.31 | 4023.44 | 4101.56 | 4179.69 | 4257.81 | 4335.94 |
| CVC MODE | VOLTAGE (V) | 1681.37 | 1700.92 | 1720.47 | 1740.02 | 1759.57 | 1779.12 | 1798.67 | 1818.22 |
| | RANGE | 55 | 56 | 57 | 58 | 59 | 5A | 5B | 5C |

| | | | | | | | | | |
|---|---|---|---|---|---|---|---|---|---|
| CCC MODE | RANGE | 38 | 39 | 3A | 3B | 3C | 3D | 3E | 3F |
| | VOLTAGE (V) | 4414.06 | 4492.19 | 4570.31 | 4648.44 | 4726.56 | 4804.69 | 4882.81 | 4960.94 |
| CVC MODE | VOLTAGE (V) | 1837.77 | 1857.32 | 1876.88 | 1896.43 | 1915.98 | 1935.53 | 1955.08 | 1974.63 |
| | RANGE | 5D | 5E | 5F | 60 | 61 | 62 | 63 | 64 |

IMAGE FORMING APPARATUS INCLUDING A CHARGING POWER SUPPLY AND A NEUTRALIZING DEVICE

FIELD OF THE INVENTION

The present invention relates to an electrophotographic image forming apparatus.

DESCRIPTION OF THE PRIOR ART

An electrophotographic printer is a well-known prior art apparatus which performs the steps of charging, exposing, developing, transferring, and fixing.

The charging unit usually takes the form of a corona charger, which requires a high voltage power supply for outputting a high voltage of about 5–10 kV. A special care must be taken when handling the power supply. In addition, the high voltage power supply is very expensive. A corona charger suffers from a problem that the potential of the charged surface of a latent image bearing body is susceptible to environmental conditions such as humidity. The corona charger uses a corona discharge phenomenon which creates ozone. Ozone deteriorates the characteristics of the latent image bearing body and is harmful to human body as well. In order to prevent harmful effects to human body, a filter which absorbs and decomposes ozone is provided in the apparatus, thereby preventing escape of ozone. However, the lifetime of the filter is relatively short and therefore must be periodically replaced.

In order to solve the problems of corona charger, Japanese Patent Preliminary Publication (KOKAI) No. 63-208878 discloses a contact type charging device in which a charging roller having an electrical resistance ranging from $10^5$ to $10^6$ Ω is brought into contact with the latent image bearing body and a direct current voltage is applied to the charging roller so as to charge the latent image bearing body.

FIG. 30 illustrates a general construction of a prior art electrophotographic printer having a contact type charging device.

The prior art image forming apparatus will be described with reference to FIG. 30.

An electrostatic latent image bearing body in the form of a photoconductive drum 1 is rotatably supported. Disposed around the photoconductive drum 1 are a charging roller 2, exposing unit having an LED head 3, developing unit 4, transfer roller 7, cleaning device 9, aligned in the order of respective stages of image-forming process. The charging roller 2 receives a negative voltage from a charging power supply 10 in the form of a constant voltage source.

FIG. 31 is a flowchart illustrating the outline of the photographic printing operation of the prior art apparatus.

The charging roller 2 rotates in contact with the photoconductive drum 1 to charge the surface of the photoconductive drum 1 (S501). The charging power supply 10 provides a voltage such that the surface of the photoconductive drum is charged to −800 V. The exposing unit 3 illuminates the charged surface of the photoconductive drum 1 to form an electrostatic latent image on the photoconductive drum 1 (S502). The electrostatic latent image is then developed with toner by a developing roller into a toner image (S503). Then, paper 6 passes a transfer point defined between the photoconductive drum 1 and a transfer roller 7. The transfer roller 7 receives a voltage of a polarity opposite to that of the toner images formed on the photoconductive drum 1. The voltage creates an electric field between the transfer roller 7 and the photoconductive drum 1, thereby transferring the toner image to paper 6 (S504). Residual toner particles remaining on the photoconductive drum 1 after transferring operation are removed by the cleaning device 9 from the photoconductive drum 1 (S505).

With the aforementioned prior art apparatus, many small areas on the photoconductive drum of about 0.5 mm-diameter are extremely charged when the apparatus is operated in a high-temperature and high-humidity environment. Such overcharged areas cause local non-uniform charging of the surface of the photoconductive drum 1.

Another problem is that the surface of the photoconductive drum 1 is not charged to a desired potential in an environment of low-temperature and low-humidity and therefore toner will adhere to non-latent image areas. This phenomenon is apt to occur when the latent image bearing body rotates at high speeds.

The prior art image forming apparatus which has been described with reference to FIG. 30 suffers from the following disadvantages.

The potential of the photoconductive drum 1 is determined by the voltage that is applied to the charging roller 2, the capacitance of the photoconductive drum 1, and the impedance of the charging roller 2.

The surface of the photoconductive drum 1 is charged to, for example, −800 V. We assume typical values of the parameters as follows:

Output voltage of charging power supply=Vch (volts)

Capacitance of the photoconductive drum=Cch (farads)

Impedance of the charging roller=Rch (ohms)

If the charging roller has an impedance higher than Rch, the surface of the photoconductive drum 1 is charged to a potential closer to zero volts than −800 V. If the photoconductive drum 1 has a capacitance larger than Cch, the surface of the photoconductive drum 1 is closer to zero volts than −800 V. The impedance of the charging roller 2 and the capacitance of the photoconductive drum 1 vary due to manufacturing variations. Moreover, the impedance of the charging roller 2 is susceptible to the temperature and humidity of an environment in which the printer is placed. Changes in the impedance of the charging roller 2 and capacitance of the photoconductive drum 1 greatly affect the surface potential of the photoconductive drum 1 of the printer.

In the specification, the term "image-forming device (IFD)" is used to cover a structure consisting of the charging roller 2, photoconductive drum 1, developing unit 4, and cleaning device 9. Image-forming devices IFD-1 and IFD-2 are subjected to a test in which the surface potential of the photoconductive drum 1 is measured when the charging power supply 10 provides a voltage of −1350 V to the charging roller 2. The test was conducted under two different environmental conditions; 10° C. and 20% RH, and 28° C. and 80% RH.

FIG. 32 shows the test results.

As shown in FIG. 32, the surface potential of the photoconductive drum 1 deviates from a target value of −800 V depending on the image-forming devices and environmental conditions. For example, IFD-1 was charged to −800 V in 10° C., 20% RH environment but to —about −920 V in a 28° C., 80%RH environment.

Deviation of the surface potential of the photoconductive drum 1 from the target voltage of −800 V results in poor image quality. For example, if the surface potential deviates upward from the target voltage (e.g., to −600 V), toner will adhere to non-image areas on the photoconductive drum 1 with the result that white part of the print paper will be soiled. Another problem is that the potential difference between illuminated areas and non-illuminated areas is small, loosing sharpness of images as well as resulting too dense print results. Conversely, if the surface potential deviates downward from the target voltage (e.g., to −1000 V), image areas are not sufficiently neutralized when illuminated by the exposing unit, attracting less toner during the developing process. Thus, print result is less dense.

As mentioned above, changes in the capacitance of the photoconductive drum 1 and changes in the impedance of the charging roller 2 result from environmental conditions (temperature and humidity) and change over time. Such changes cause changes in the surface potential of the photoconductive drum 1, thereby resulting in adverse effects on the print results.

Printing speed is another factor that affects the range of variations of the electrical resistance of the charging roller 2 in which a reasonable image can be formed. At higher printing speeds, the range of electrical resistance in which good image is obtained becomes narrower. Thus, as the printing speed increases, it is increasingly difficult to accommodate changes in electrical resistance of the charging roller resulting from changes in environmental conditions. There is more chance of the photoconductive drum being charged poorly.

SUMMARY OF THE INVENTION

An object of the present invention is to provide an image forming apparatus which does not cause non-uniform charging of the surface of the photoconductive drum and adhesion of toner to non-image areas.

An electrophotographic image forming apparatus is a printer in which an electrostatic latent image is formed on a charged surface of an electrostatic latent image bearing body such as photoconductive drum. The image is developed with toner into a toner image and the toner image is transferred to a recording medium. A charging roller is in contact with the photoconductive drum and charges the photoconductive drum when the charging roller receives a high voltage. A detector detects a condition such as an electrical resistance of the charging roller and outputs a signal indicative of the condition. A charging power supply applies a high voltage to the charging roller, the high voltage having a value in accordance with the signal.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are at limitative of the present invention, and wherein:

FIGS. 4A–4F show Tables 1–6;

FIGS. 8A–8C illustrate Tables 7–9;

FIGS. 10A–10C illustrate Tables 10–12;

FIGS. 12A–12C illustrate Tables 13–15;

FIGS. 25A–25D illustrate Tables I–IV, respectively;

DESCRIPTION OF THE INVENTION

Figure 1:
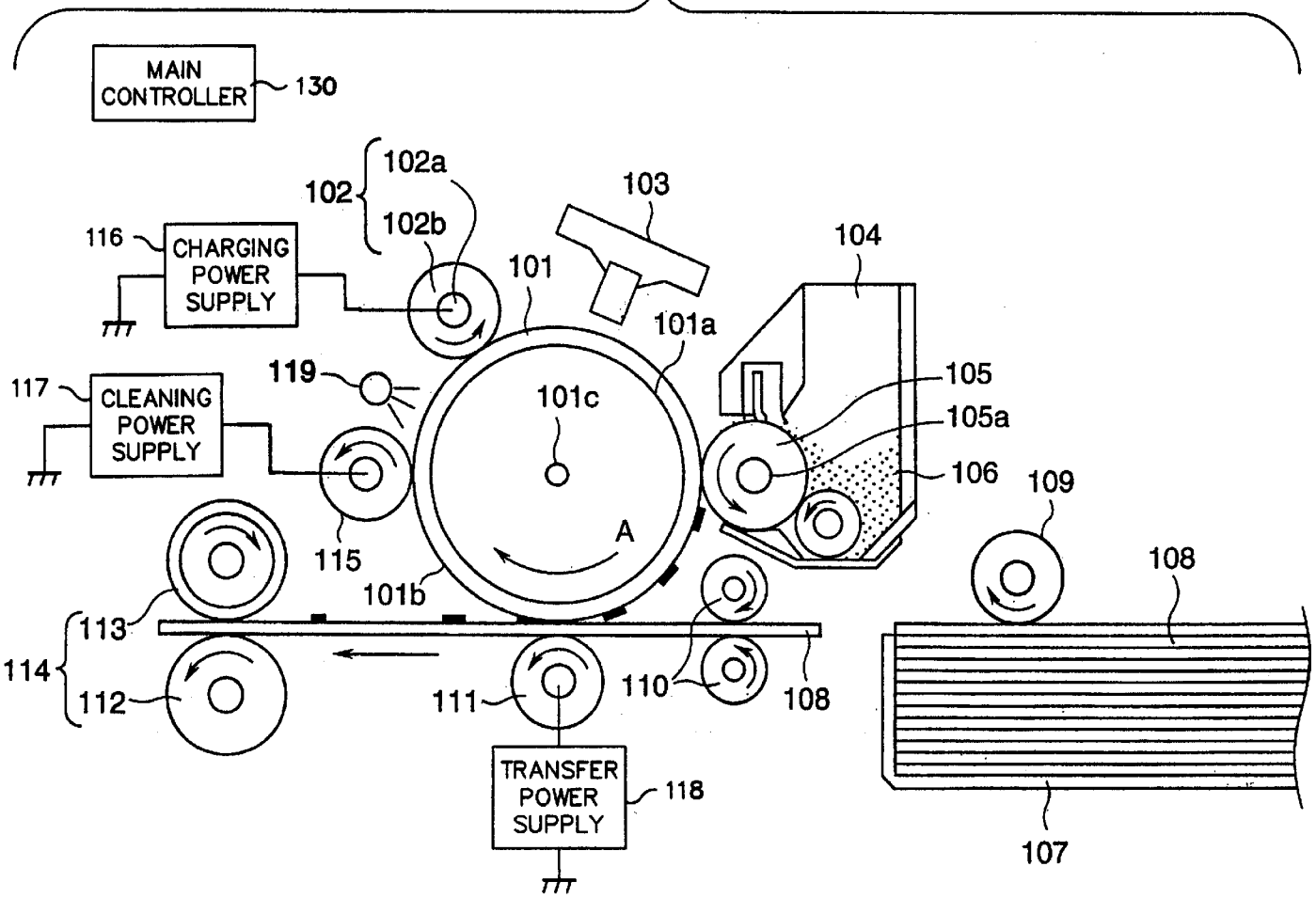
FIG. 1 illustrates a general construction of an image forming apparatus according to the first embodiment.

Preferred embodiments of the present invention will be described in detail with reference to the accompanying drawings.

Elements of the same construction have been given the same reference numerals throughout the embodiments and the description thereof is omitted.

First Embodiment

A first embodiment is characterized in that the conditions of the charging roller are checked prior to an image forming process, thereby allowing stable charging of the electrostatic latent image bearing body under changes in environmental conditions even when the apparatus operates at high printing speeds.

A charging power supply 116 is first controlled in a constant current control mode, which will be described later, so that the output voltage of the power supply is monitored to check the conditions of the charging roller and the electrostatic latent image bearing body. When an image is actually formed, the power supply is switched to a constant voltage control mode. The output voltage in the constant voltage control mode is set based on the conditions which were monitored during the constant current control mode.

<General construction>

FIG. 1 illustrates a general construction of an image forming apparatus according to the first embodiment.

The general construction of the apparatus will be described with reference to FIG. 1.

A main controller 130 controls timings at which the respective units disposed around the photoconductive drum 101 are operated.

A photoconductive drum 101 is driven in rotation by a main motor, not shown, in a direction shown by arrow A.

A charging unit or charging roller 102 uniformly charges the surface of the photoconductive drum 101. Then, an exposing unit 103 illuminates the charged surface of the photoconductive drum 101 in accordance with an image signal, thereby forming an electrostatic latent image on the charge surface of the photoconductive drum 101. The exposing unit 103 takes the form of, for example, an LED array combined with a SELFOC LENS (trade name) or a laser combined with an image-forming optical system.

The electrostatic latent image is developed by a developing unit 104. A toner carrying body or developing roller 105 in the developing unit 104 attracts toner 106 thereto and rotates in a direction shown by an arrow, thereby carrying toner from the developing unit 104 to the photoconductive drum 101. A bias voltage is applied across a shaft 101*c* of the photoconductive drum 101 and a shaft 105*a* of the developing roller 105, so that an electric field is developed between the developing roller 105 and the photoconductive drum 101. The toner 106 on the developing roller 105 is charged and the charged toner particles are attracted by the Coulomb force to the electrostatic latent image, developing the electrostatic latent image into a visible image, or toner image. The developing unit 104 may be in the form of, for example, any of known two-composition magnetic brush developing unit, one-composition magnetic brush developing unit, and one-composition non-magnetic developing unit.

A feeding roller 109 feeds recording paper 108 from a paper cassette 107 to registry rollers 110 which is at rest. The recording paper 108 abuts the registry rollers 110 which in turn correct the skew of the recording paper 108. Then, the registry rollers 110 are driven into rotation to advance the recording paper 108 into the transfer unit 111.

A transfer unit 111 transfers the toner image on the photoconductive drum 101 to the recording paper 108.

Then, the recording paper 108 is further transported to a fixing unit 114 where the toner image is fused. In other words, the recording paper 108 passes between a heat roller 113 and a pressure roller 112 in pressure contact with the heat roller 113. The heat generated by the heat roller 113 fuses the toner image and the pressure roller 112 presses the fused toner into the recording paper 108. After the fixing, the recording paper 108 is discharged out of the apparatus.

Some toner may remain on the photoconductive drum 101 after the transfer operation. The residual toner is removed by a cleaning roller 115 which is in contact with photoconductive drum 101 and receives a predetermined voltage from a cleaning power supply 117.

Major features of the image-forming apparatus according to the first embodiment lie in the control of voltage applied to the charging roller 102. Thus, the embodiment will be described with respect to the charging power supply 116 and associated sections, photoconductive drum 101, and charging roller 102.

<Photoconductive drum>

The photoconductive drum 101 will be described.

The photoconductive drum 101 includes an electrically conductive support 101*a* and a photoconductive layer 101*b*. The electrically conductive support 101*a* is an aluminum pipe having an outer diameter of 30 mm. Other metal pipe such as stainless steel pipe and steel pipe may be used.

The photoconductive layer 101*b* is formed of a multi-layer organic photoconductive material which is formed by applying an about 0.5 $\mu$mm-thick charge-generating layer deposited alternately with an about 18$\mu$mm-thick charge-transporting layer. The photoconductive layer may be of other multi-layer type having a charge-generating layer and a charge-transport, or of a single layer type having one charge-generating layer and one charge-transporting layer. While the photoconductive layer 101*b* is formed of an organic photoconductive material, other photoconductive material such as selenium photoconductor, Zinc oxide photoconductor, amorphous silicone photoconductor may also be used.

<Charging roller>

The charging roller 102 will be described.

The charging roller 102 is a metal shaft 102*a* with a semiconductive rubber layer 102*b* molded thereon. The metal shaft 102*a* is, for example, a stainless steel having a diameter of 6 mm. Other metal such as steel and aluminum may be used. The semiconductive rubber layer 102*b* of the embodiment is a semiconductive urethane rubber formed by adding conductive carbon black to urethane rubber. The semiconductive urethane rubber is molded into a semiconductive rubber layer 102*b* having an outer diameter of 14 mm and an axial length of 320 mm. The axial length of semiconductive layer 102*b* is determined by the axial length of the photoconductive drum 101. The semiconductive rubber layer 102*b* is difficult to be shaped at extreme axial ends and therefore the semiconductive rubber layer 102*b* is somewhat longer than the axial length of the photoconductive drum 101 so that the uniformly formed semiconductive layer 102*b* extends across the full length of the photoconductive drum 101.

The semiconductive rubber layer 102*b* may be formed of other material such as a rubber material with electrically conductive powder, metal powder, or metal fiber mixed therein. The rubber material includes butyl rubber, chloroprene rubber, urethane rubber, silicone rubber, nitrile rubber, styrene rubber, butadiene rubber, fluororubber, and ethylene propylene rubber. Carbon and graphite may be used as the electrically conductive powder. The metal powder and metal fiber includes ferrite, aluminum powder, copper powder, bronze powder, stainless steel powder, and powder or fiber of titanium oxide and stannous oxide.

The charging roller 102 is preferably a resilient body so that the charging roller 102 contacts the photoconductive drum 101 uniformly across the length of the charging roller 102. The aforementioned rubber materials offer a hardness less than 40° (JIS A) for a solid semiconductive rubber layer and 20–60° (ASKER C) for a foamed semiconductive rubber layer.

The charging power supply 116 is connected between the metal shaft 102*a* of the charging roller 102 and the electrically conductive support 101*a* of the photoconductive drum 101. The charging power supply 116 applies a d-c voltage to the charging roller 102 through the metal shaft 102*a*.

<Charging power supply and a neutralizing device>

Figure 2:
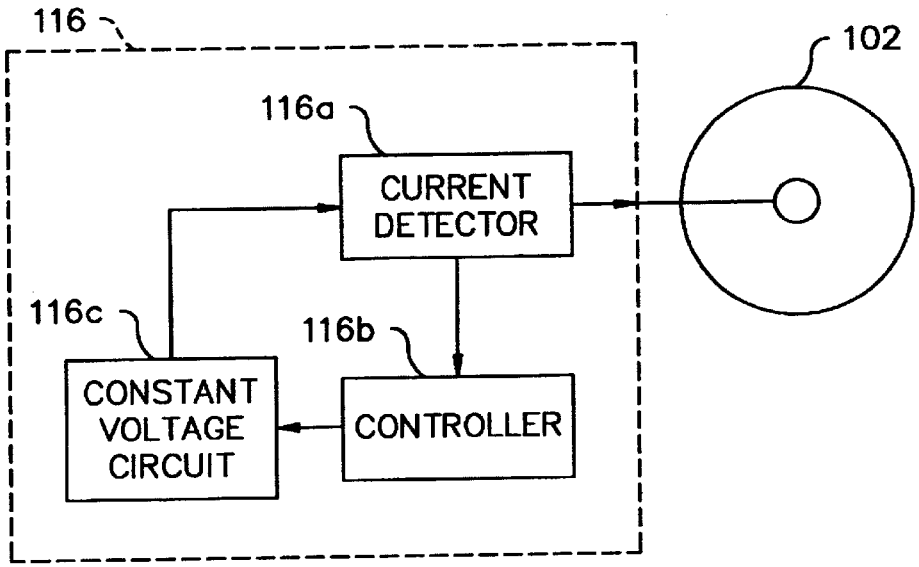
FIG. 2 illustrates a charging power supply 116 of the first embodiment.

FIG. 2 illustrates a charging power supply 116 of the first embodiment.

The charging power supply 116 and a neutralizing device 119 will be described in detail.

The charging supply 116 applies a predetermined high voltage to the charging roller 102 to charge the surface of the photoconductive drum 101 to a desired potential. The charging power supply 116 is adapted to be controlled in two modes. Prior to an image-forming operation i.e., when the image forming apparatus is set up, and prior to when image-forming process is started, the power supply 116 is operated in the constant current control mode (referred to as CCC mode hereinafter). During the operation in the CCC mode, the output voltage of the charging power supply is monitored. When the image-forming process is being carried out, the power supply 116 is operated in a constant voltage control mode (referred to as CVC mode hereinafter). In the CVC mode, the charging power supply 116 is controlled to provide an output voltage to the charging roller, the output voltage being in accordance with the monitored output voltage of the charging power supply during the CCC mode.

The charging power supply 116 provides a voltage of −1.35 kV to the charging roller 102 in the CVC mode. Applying a voltage in the range from −1 kV to −1.7 kV enables charging of the photoconductive drum 101 to −400 V to −1000 V.

As shown in FIG. 2, the charging power supply 116 includes a current detector 116*a*, a controller 116*b*, and a constant voltage circuit 116*c*.

The constant voltage circuit 116*c* is a power supply circuit that generates a desired voltage in accordance with an instruction transmitted from the controller 116*b*. The output voltage of the constant voltage circuit 116*c* is applied to the charging roller 102 through the current detector 116*a*. The current detector 116*a* detects a current that flows from the constant voltage circuit 116*c* to the charging roller 112.

The controller 116*b* includes a memory, processor, and various driver circuits, and controls the operation of the constant voltage circuit 116*c*. The processor executes control programs stored in the memory, thereby implementing a variety of functions including an application of a voltage of a predetermined value to the charging roller 102. The controller 116*b* controls the constant voltage circuit 116*c* in accordance with the detection result of the current detector 116*a*, so that the charging roller 102 is energized with a desired current, i.e., in the CCC mode. The controller 116*b* monitors the voltage when the charging power supply 116 operates in the CCC mode.

<Functions>

The variety of functions will be described in detail with reference to FIG. 1.

Desired charging voltages and currents are determined experimentally and stored in the memory. The value of a current in the CCC mode and charging potential of the photoconductive drum 101 are set according to the voltages and currents stored in the memory.

The Desired charging voltages and currents may also be determined by Equation (1) as follows:

$$\text{Current setting } I=(Vp\times L\times eo\times es\times Vs)/t \quad (1)$$

where t: the thickness of the photoconductive layer 101*b* [m];

es: the relative dielectric constant of the photoconductive layer 101*b;*

Vp: the peripheral speed of the photoconductive drum 101 [m/sec];

L: the length of the semiconductive rubber layer 102*b* [m];

Vs: the charging potential of the photoconductive drum 101 [V]; and eo: dielectric constant in free space [F/m].

A length of time t2 required for the charging roller 102 to make a complete rotation is computed from the peripheral speed of the charging roller 102 [m/s], and the peripheral distance of the charging roller 102 [m]. Then, an average output voltage of the charging power supply 116, i.e., an average value of the voltage applied to the charging roller 102 during the length of time t2 is determined.

The charging power supply 116 provides a negative high voltage to the charging roller 102. This is because the photoconductive drum 101 used is of a negatively-charged type. If a photoconductive drum of a positively-charged type, the charging power supply 116 is designed to provide a positive voltage to the charging roller 102.

A neutralizing device 119 (FIG. 1) is used to neutralize the photoconductive drum 101 by illuminating the surface of the photoconductive drum 101. The neutralizing device 119 neutralizes an area of the surface of the photoconductive drum 101, downstream of the cleaning roller 115 and upstream of the charging roller 102 with respect to the rotation of the photoconductive drum 101. The neutralizing device 119 includes a light source in the form of LED arrays having substantially the same wavelength and intensity as the LED arrays used in the exposing unit 103. Other type of light source may be used in place of the LED arrays as long as efficient light (e.g., wavelength) is emitted for neutralizing the photoconductive drum 101.

This type of neutralizing device 119 is employed for the following reasons.

When the charging power supply 116 is operated in the CCC mode, the potential of the charged surface of the photoconductive drum 101 will increase. For example, the charging power supply 116 is assumed to operate at a constant current of −55 $\mu$A in the CCC mode so that when the recording speed is 200 mm/sec, the target potential of the charged surface of the photoconductive drum 101 is −600 V. The surface is charged to −600 V for the first one rotation of the photoconductive drum 101. However,the surface is charged to −1200 V for the second rotation, and to −1800 V for the third rotation. In other words, the surface becomes charged increasingly high with increasing number of rotation of the photoconductive drum 101. In order to control the charging power supply 116 in the CCC mode, the potential of the photoconductive drum immediately upstream of the charging roller 102 needs to be constant at all times.

Experimental results show that the residual potential of the surface of the photoconductive drum 101 needs to be a certain low voltage, for example, 0V or −100V.

Figure 3:
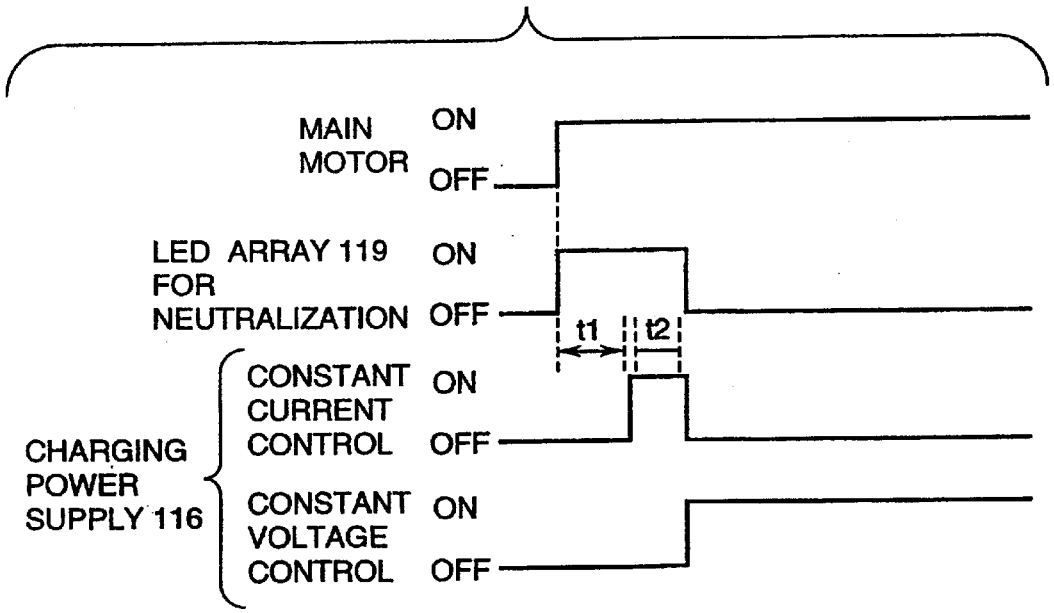
FIG. 3 illustrates timings at which various voltages are applied in the first embodiment.

FIG. 3 illustrates timings at which various voltages are applied.

The operation of the image forming process will be described with reference to FIG. 3. The operation will be described with respect to a recording speed of 200 mm/sec.

When the image forming apparatus receives a drive signal, the main motor drives the photoconductive drum 101 into rotation. At the same time, the neutralizing device 119 emits light to neutralize the surface of the photoconductive drum 101.

As the photoconductive drum 101 rotates, an area on the surface of the photoconductive drum 101 neutralized by the neutralizing device 119 is rotated into contact with the charging roller 102.

A time longer than a delay time tl after the initiation of neutralization, the controller 116*b* controls the charging power supply 116 to energize the charging roller 102 while also monitoring the detection result of the current detector 116*a*. The delay time t1 is a length of time required for a surface area of the photoconductive drum 1 to rotate to the charging roller 102 after the surface area is neutralized by the neutralizing device 119. The delay time t1 may be computed based on the rotational speed of the photoconductive drum 101 and the positions of the neutralizing device 119 and the charging roller 102 relative to the photoconductive drum 101.

The output current of the charging power supply 116 is set to −73.5 $\mu$A so as to charge the photoconductive drum 101 to a desired potential of −800 V.

The controller 116*b* monitors the output voltage of the constant voltage circuit 116*c*. The controller 116*b* computes an average value of the output voltage for a period corresponding to one complete rotation of the charging roller 102.

Then, the controller 116*b* enters the CVC mode at a predetermined timing to perform a normal image forming operation. The output voltage is set to the average value computed by the controller 116*b*. Once the charging power supply has entered the CVC mode, the neutralizing device 119 no longer performs the neutralization of the surface of the photoconductive drum 101.

In order to evaluate the advantages of the first embodiment, Experiments $1_1$ to $1_6$ were conducted. Of the experiments, Experiments $1_1$ to $1_3$ were conducted on conventional apparatus. Experiments $1_4$ to $1_6$ were carried out on the apparatus according to the first embodiment. All of Experiments were conducted under the same conditions.

Experiments $1_1$ to $1_6$ were conducted using the following five kinds of charging rollers. The charging roller 102 is a semiconductive urethane rubber roller and has the semiconductive rubber layer 102*b* formed by adding conductive carbon black to urethane rubber. All of the aforementioned five kinds of charging rollers 102 have the semiconductor rubber layer 102*b* with a length of 320 mm. Using the aforementioned five charging rollers 102, recording speed and charging characteristic of the photoconductive drum 101 were evaluated for four different recording speeds, i.e., 100, 150, 200, and 250 mm/sec. Symbol ○ indicates good charging while symbol X indicates poor charging.

Roller I: The semiconductive rubber layer 102*b* has a resistance of $5\times10^4$ Ω.

Roller II: The semiconductive rubber layer 102*b* has a resistance of $1\times10^5$ Ω.

Roller III: The semiconductive rubber layer 102*b* has a resistance of $5\times10^5$ Ω.

Roller IV: The semiconductive rubber layer 102*b* has a resistance of $1\times10^6$ Ω.

Roller V: The semiconductive rubber layer 102*b* has a resistance of $5\times10^6$ Ω.

Experiment $1_1$

The image forming apparatus was left in an environment of 20° C. and 65%. Table 1 lists the results.

"Poor charging" is grouped into two types.

If the charging roller 102 has a low resistance, then a large number of round areas on the photoconductive drum 101 having an about 0.5 mm-diameter are overcharged. Since the embodiment is based on "reversal phenomenon," variations in density, i.e., white portions appeared in the image portions.

If the charging roller 102 has a high electrical resistance, the potential of charged surface of the photoconductive drum 101 becomes lower than a predetermined value so that non-image areas attract toner.

Experiment $1_2$

The image forming apparatus was left in an environment of 40° C. and 80%. Table 2 lists the results.

Experiment $1_3$

The image forming apparatus was left in an environment of 10° C. and 35%. Table 3 lists the results.

The data listed in Tables 1, 2, and 3 reveal the following characteristics. If the recording speed is lower than 150 mm/sec, then the resistance of the charging roller 102 of $5\times10^5$ Ω did not cause any poor charging over a wide range of environment, from a low-temperature and low-humidity environment to a high-temperature and high-humidity environment.

However, for recording speeds higher than 200 mm/sec, any resistance values of the charging roller 102 caused poor charging of the photoconductive drum 101 when environmental conditions vary over a wide range of environment, i.e., from the low-temperature and low-humidity environment to the high-temperature and high-humidity environment.

The poor charging was due to the fact that the resistance of the charging roller 102 varies depending on the environmental conditions. Specifically, the resistance of the charging roller 102 increases in the low-temperature and low-humidity environment and decreases in the high-temperature and high-humidity environment. In fact, the resistance of the semiconductive urethane rubber roller changed by a factor of less than 10 (i.e., $1\times10^5$ to $1\times10^6$ Ω) due to the changes in environmental conditions.

For recording speeds lower than 150 mm/sec, good charging of the photoconductive drum is ensured over a wide range of the resistance changes of the charging roller 102, a maximum value ($5\times10^6$ Ω) of the resistance being about ten times a minimum value ($5\times10^4$ Ω). This relatively wide range of acceptable resistance changes sufficiently accommodates changes in environmental conditions.

For recording speeds lower than 200 mm/sec, good charging of the photoconductive drum is ensured over a relatively narrow range of the resistance changes of the charging roller 102, e.g., a maximum value ($5\times10^5$ Ω) of the resistance being about several times a minimum value ($1\times10^5$ Ω). This relatively narrow range of the resistance changes cannot sufficiently accommodate changes in environmental conditions.

Experiment $1_4$

The image forming apparatus was left in an environment of 20° C. and 65%. Table 4 lists the results.

Experiment $1_5$

The image forming apparatus was left in an environment of 40° C. and 80%. Table 5 lists the results.

Experiment $1_6$

The image forming apparatus was left in an environment of 10° C. and 35. Table 6 lists the results.

The data in Tables 4, 5, and 6 reveal the following relationship between the recording speed and changes in environmental conditions. For any of the recording speeds, the resistance of the charging roller 102 higher than $5\times10^5$ Ω did not cause poor charging over a wide range of environment, from the low-temperature and low humidity environment to the high-temperature and high-humidity environment.

For any of the recording speeds, the range of resistance of the charging roller 102 that provides good charging results did not change and did not cause poor charging of the photoconductive drum 101.

Thus, for recording speeds higher than 200 mm/sec, if the resistance of the charging roller 102 is higher than $5\times10^5$ Ω, good charging of the photoconductive drum is ensured over a range of the resistance of the charging roller 102 having a maximum value about ten times a minimum value. This relatively wide range of the resistance changes accommodates changes in environmental conditions, preventing poor charging. Thus, images with sharp contrast can be recorded during an extended period of time without variations in the density of print results or unwanted deposition of toner on non-image areas of the recording paper.

According to the first embodiment, even if recording speed is high, the photoconductive drum 101 can be charged uniformly with good stability, thereby preventing white portions in image areas and unwanted deposition of toner on non-image areas.

The embodiment can record images with high contrast, high resolution, or high gradation levels both during an extended period of time and regardless of changes in environmental conditions.

The present invention allows the resistance of the charging roller 102 to lie in a range wider than that of the conventional apparatus, offering an advantage of reducing the cost of the charging roller 102.

Second Embodiment

A second embodiment differs from the first embodiment in that the charging power supply 116 is controlled in a different sequence. Specifically, the controller 116*b* controls the charging power supply 116 in the CVC mode, CCC mode, and CVC mode in this order. The initial charging in the CVC mode reduces unwanted toner deposition on a non-charged area of the photoconductive drum.

Figure 5:
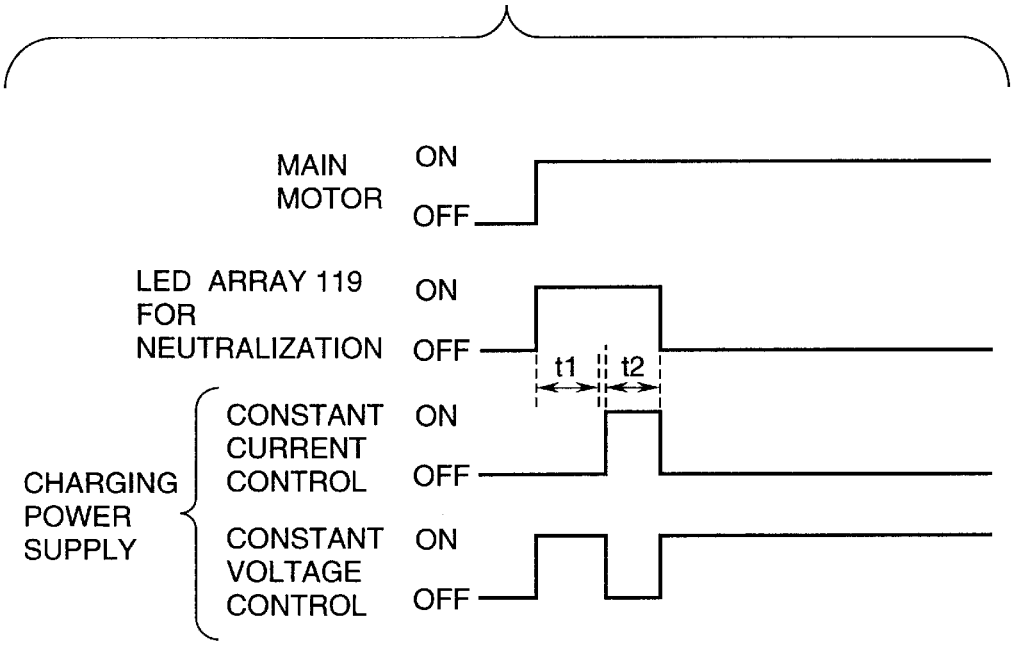
FIG. 5 illustrates timings at which various voltages are applied in the second embodiment.

FIG. 5 illustrates timings at which various voltages are applied in the second embodiment.

The operation of charging power supply 116 when the image forming process begins will be described with reference to FIG. 5.

The recording speed is assumed to be 200 mm/sec. When the image forming apparatus receives a drive signal, the main motor drives the photoconductive drum 101 into rotation. At the same time, the neutralizing device 119 emits light to neutralize the surface of the photoconductive drum 101.

The charging power supply 116 operates in the CVC mode to apply a voltage of −1350 V to the charging roller 102, thereby charging the photoconductive drum 101.

As the photoconductive drum 101 rotates, an area on the surface of the photoconductive drum 101 neutralized by the neutralizing device 119 is rotated into contact with the charging roller 102. A time longer than a delay time t1 after the initiation of neutralization, the controller 116*b* controls the charging power supply 116 to energize the charging roller 102 while also monitoring the detection result of the current detector 116*a*. The delay time t1 is a length of time required for a surface area of the photoconductive drum 1 to rotate to the charging roller 102 after the surface area is neutralized by the neutralizing device 119. The time t1 may be computed based on the rotational speed of the photoconductive drum 101 and the positions of the neutralizing device 119 and the charging roller 102 relative to the photoconductive drum 101.

The output current of the charging power supply 116 is set to −73.5 μA so as to charge the photoconductive drum 101 to a desired potential of −800 V.

The controller 116*b* monitors the output voltage of the constant voltage circuit 116*c*. The controller 116*b* computes an average value of the output voltage for one complete rotation of the charging roller 102.

Then, the controller 116*b* enters the CVC mode at a predetermined timing to perform a normal image forming operation. The output voltage is set to the average value computed by the controller 116*b*. After the charging power supply enters the CVC mode, the neutralizing device 119 no longer performs neutralization of the surface of the photoconductive drum 101.

Experiments were conducted to evaluate the effects of the second embodiment. An experiment was conducted under the same conditions as Experiments $1_4$ to $1_6$ in the first embodiment except that the charging power supply 116 was operated in the CVC mode, CCC mode, and CVC mode in this order.

The experimental results were similar to those of Experiments $1_4$ (Table 4), $1_5$ (Table 5), and $1_6$ (Table 6). If the resistance of the charging roller 102 is higher than $5\times10^5$ Ω, good charging of the photoconductive drum 101 is ensured over a wide range of resistance of the charging roller 102 having a maximum value of the resistance about ten times higher than a minimum value. This relatively wide range of the resistance accommodates changes in environmental conditions. Thus, images with sharp contrast can be recorded during an extended period of time without variations in the density of print result or unwanted deposition of toner on non-image areas of the recording paper.

According to the second embodiment, even if the image forming apparatus operates at a high recording speed, stable, uniform charging of the photoconductive drum 101 can be effected.

According to the second embodiment, the resistance of the charging roller 102 is allowed to vary over a wider range than the conventional method of charging. Thus, the charging roller can be inexpensive.

If an apparatus is based on "reversal phenomenon," if an area on the photoconductive drum 101 is not charged, the toner 106 will be deposited on that area of the photoconductive drum 101. In the second embodiment, the charging roller 102 begins to charge the photoconductive drum 101 at the same time that the photoconductive drum 101 begins to rotate. Thus, the toner 106 is deposited on the photoconductive drum for a shorter period by t1 in the second embodiment than in the first embodiment. This implies that the area in which the toner 106 is deposited is smaller by an area corresponding to t1. As a result, waste of toner can be minimized, saving the running cost of the apparatus.

The aforementioned first and second embodiments may be constructed as follows:

The charging roller 102 is not limited to the semiconductive rubber roller, but may be a charging blade in the shape of a slab of a semiconductive material disclosed in Japanese Patent Preliminary Publication (KOKAI) No. 2-264974 or a charging brush formed of a semiconductive fiber disclosed in Japanese Patent Preliminary Publication (KOKAI) No. 1-309076. The charging roller may also be replaced by a charging belt in the shape of an endless belt of a semiconductive sheet or film. Still another alternative is a cleaning and charging blade that is formed of a semiconductive plate-like member disclosed in Japanese Patent Preliminary Publication (KOKAI) No. 60-147756.

The neutralizing device 119 may neutralize other area of the surface of the photoconductive drum 101. For example, the neutralizing device 119 may be disposed downstream of the transfer device 111 with respect to the rotation of the photoconductive drum and upstream of the cleaning roller 115. The neutralizing device is not limited to one using light. Instead, the neutralizing device 119 may be a contact type in which a semiconductive member is pressed against or contacted with the photoconductive drum 101 and an a-c voltage is applied to the semiconductive member.

In the first and second embodiments, when the charging power supply 116 is operated in the CCC mode, in order to determine an average of the output voltage, the output voltage is monitored for a period corresponding to one rotation of the charging roller 102. The output voltage may be monitored for a different period from the one rotation of the charging roller, for example, two rotations or three rotations of the charging roller 102, and an average may be calculated. Still alternatively, the output may be monitored voltage for a period corresponding to one complete rotation of the photoconductive drum 101, thereby computing an average of the output voltage.

Third Embodiment

A third embodiment will be described with reference to FIGS. 6 and 7.

Figure 6:
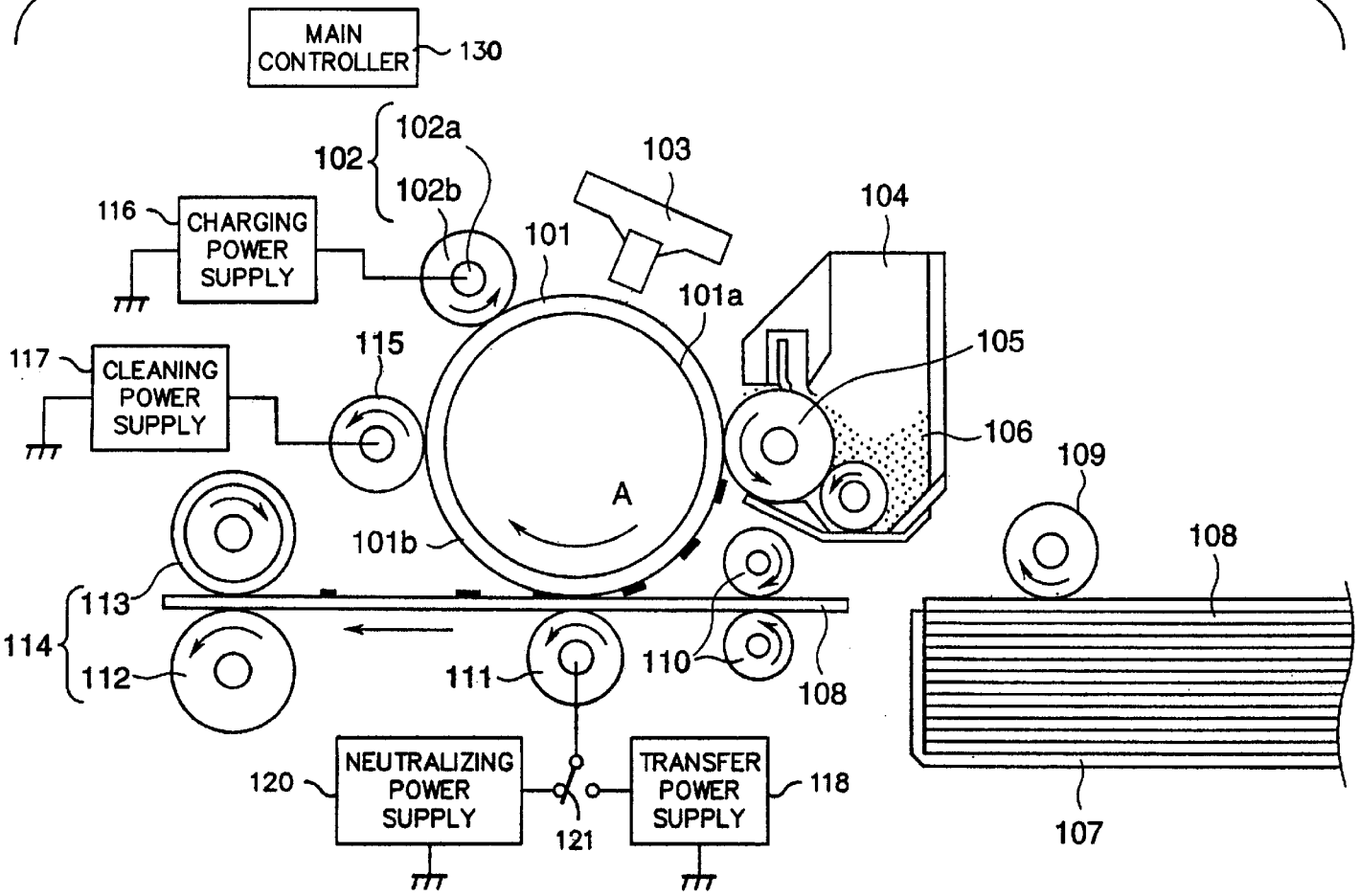
FIG. 6 illustrates a general construction of an image forming apparatus according to a third embodiment.

The third embodiment differs from the first embodiment in that the transfer unit 111 is used to neutralize the photoconductive drum 101 (FIG. 6). The control mode of the charging power supply 116 is switched not only immediately before the image-forming process but also during the image forming process. For example, the control mode may be switched at a timing between consecutive pages. The rest of the operation is the same as the first embodiment. Thus, the third embodiment will be described with respect to the operation different from the first embodiment.

FIG. 6 illustrates a general construction of an image forming apparatus according to the third embodiment.

The transfer unit according to the third embodiment is a "transfer roller 111". The transfer roller 111 is connected to the neutralizing power supply 120 separate from the transfer power supply 118 as shown in FIG. 6. The transfer roller 111 is selectively connected by a selector switch 121 to the transfer power supply 118 and the neutralizing power supply 120.

The neutralizing power supply 120 is a power supply that generates an a-c voltage of a predetermined frequency. The output of the neutralizing power supply 120 is applied to the transfer roller 111 so that the transfer roller 111 serves as an a-c neutralizing device as well as a charging device.

The inventors conducted a variety of experiments in order to determine an optimum voltage value and frequency of a voltage used for neutralization. The experiments revealed that an optimum a-c voltage is in the range of 1–4 kVp-p (offset voltage is 0 V) or 350–1200 Vrms, depending on the resistance of the transfer roller 111. If the frequency of the voltage is too high or too low, variations in neutralization effect occur. It is desirable that the polarity of the voltage changes a plurality of times (preferably more than ten times) when the surface of the photoconductive drum passes through an area where a very weak discharge occurs between the transfer roller 111 and the photoconductive drum 101. Good results were obtained using a frequency in the range of 40–3000 Hz depending on the rotational speed of the photoconductive drum 101.

The selector switch 121 is switched in accordance with an instruction output from a main controller 130. The third embodiment is not provided with the neutralizing device 119.

In the third embodiment, the charging power supply 116 applies a voltage of −1.4 kV to the charging roller 102 when the charging power supply 116 operates in the CVC mode. When a voltage in the range from −1 to −1.7 kV is applied to the charging roller 102, the photoconductive drum 101 is charged to −400 to −1000 V. A voltage of the same value applied to the charging roller 102 results in different potential of the surface of the photoconductive drum 101 depending on the thickness, relative dielectric constant, and other factors of the photoconductive layer 101*b*.

Figure 7:
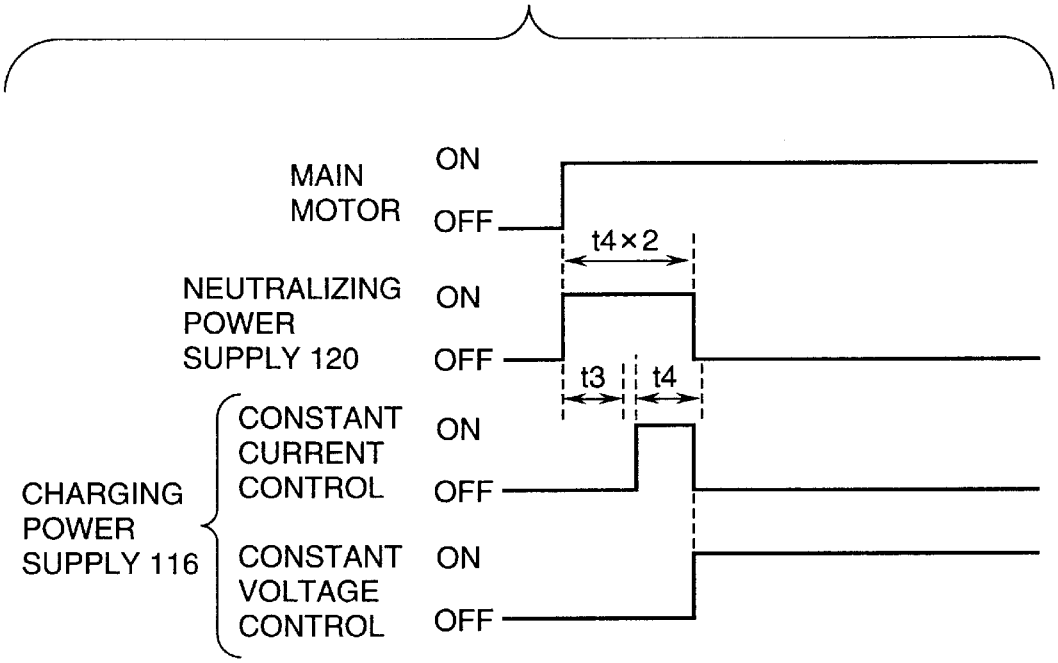
FIG. 7 illustrates timings at which various voltages are applied.

FIG. 7 illustrates timings at which various voltages are applied.

The operation of the image forming process will be described with reference to FIG. 7.

When a drive signal is input into the image forming apparatus, the main motor drives the photoconductive drum 101 into rotation. At the same time, the neutralizing power supply 120 applies an a-c voltage to the transfer roller 111 to begin to neutralize the photoconductive drum 101. The neutralizing power supply 120 applies the a-c voltage to the photoconductive drum 101 for a period of time equivalent to two complete rotations of the charging roller 102. After this period, the neutralizing power supply 120 stops generating the a-c voltage while also shifting the switch 121 to the side of the transfer power supply 118. From this time point onward, the transfer power supply 118 applies a d-c voltage to the transfer roller 111 prior to the normal image forming operation. The d-c voltage ranges from +500 to +5000V depending on, for example, the resistance of the transfer roller 111 and thickness of the recording paper 108.

As the photoconductive drum 101 rotates, an area in the surface of the photoconductive drum neutralized by the transfer roller 111 rotates to the contact region where the photoconductive drum 101 is in contact with the charging roller 102.

Longer than delay time t3 after the initiation of neutralization, while monitoring the detection output of the current detector 116*a*, the controller 116*b* of the charging power supply 116 begins to energize the charging roller 102 to charge the photoconductive drum 101. Delay time t3 is a length of time from when the transfer roller 111 begins to neutralize an area of the surface of the photoconductive drum 101 till the neutralized area rotates to the charging roller 102. Delay time t3 can be computed based on the rotational speed of the photoconductive drum 101 and the positional relations of the transfer roller 111 and the charging roller 102 relative to rotation of the photoconductive drum 101.

The output current of the charging power supply 116 is set to −60 μA so as to charge the photoconductive drum 101 to a desired potential. The controller 116*b* monitors the output voltage of the constant voltage circuit 116*c*. The controller determines an average value (referred to as average voltage hereinafter) of the output voltage of the constant voltage circuit 116*c* for a length of time required for the charging roller 102 to make one complete rotation. The time t4 required for the charging roller 102 to make one complete rotation is computed based on the peripheral speed and circumference of the charging roller 102.

Then, the controller 116*b* enters the CVC mode at a predetermined timing, thereby carrying out the normal image forming operation. The voltage setting in the CVC mode is the same as the aforementioned average voltage computed by the controller 116*b*.

In order to determine the advantages of the third embodiment, Experiments $3_1$ to $3_3$ were conducted using the apparatus according to the third embodiment. Five kinds of charging rollers were used which are the same Rollers I–V as were used in Experiments $1_1$ to $1_6$. Using the aforementioned five charging rollers 102, the recording speed and charging characteristic of the photoconductive drum 101 were evaluated for four different recording speeds, i.e., 100, 150, 200, and 250 mm/sec. In Tables 8–9, Symbol ○ indicates good charging while X indicates poor charging.

Experiment $3_1$

The image forming apparatus was left in an environment of 20° C. and 65%. Table 7 lists the results.

Experiment $3_2$

The image forming apparatus was left in an environment of 40° C. and 80%. The rest of the experiment conditions are the same as Experiment $3_1$. Table 8 lists the results.

Experiment $3_3$

The image forming apparatus was left in an environment of 10° C. and 35%. The rest of the experiment conditions are the same as Experiment $3_1$. Table 9 lists the results.

Tables 7–9 revealed that the apparatus of the third embodiment has the following characteristics with respect to the changes in environment and recording speed.

The resistance of the charging roller 102 higher than $5\times10^5$ Ω showed good charging characteristics at any speeds over a wide range of environment, i.e., from a low-temperature and low-humidity environment to a high temperature and high-humidity environment.

The above-described results reveal that for recording speeds higher than 200 mm/sec, if the resistance of the charging roller 102 is higher than $5\times10^5$ Ω, good charging of the photoconductive drum 101 is ensured over a range of the resistance of the charging roller 102 having a maximum value about ten times a minimum value. This relatively wide range of the resistance of the charging roller accommodates changes in environmental conditions, preventing poor charging. Thus, images with sharp contrast can be recorded during an extended period of time without variations in the density of print result or unwanted deposition of toner on non-image areas of the recording paper.

According to the third embodiment, even if the recording speed is high, the photoconductive drum 101 can be charged uniformly with good stability, thereby preventing white portions in an image resulting from insufficient deposition of toner and unwanted deposition of toner on non-image areas.

The third embodiment allows stable recording of images at high speed with high contrast, high resolution, or many gradation steps both during an extended period of time and regardless of changes in environmental conditions.

The present invention allows the resistance of the charging roller 102 to vary over a wider range than the conventional apparatus, offering an advantage of reducing the cost of the charging roller 102.

Fourth embodiment

Figure 9:
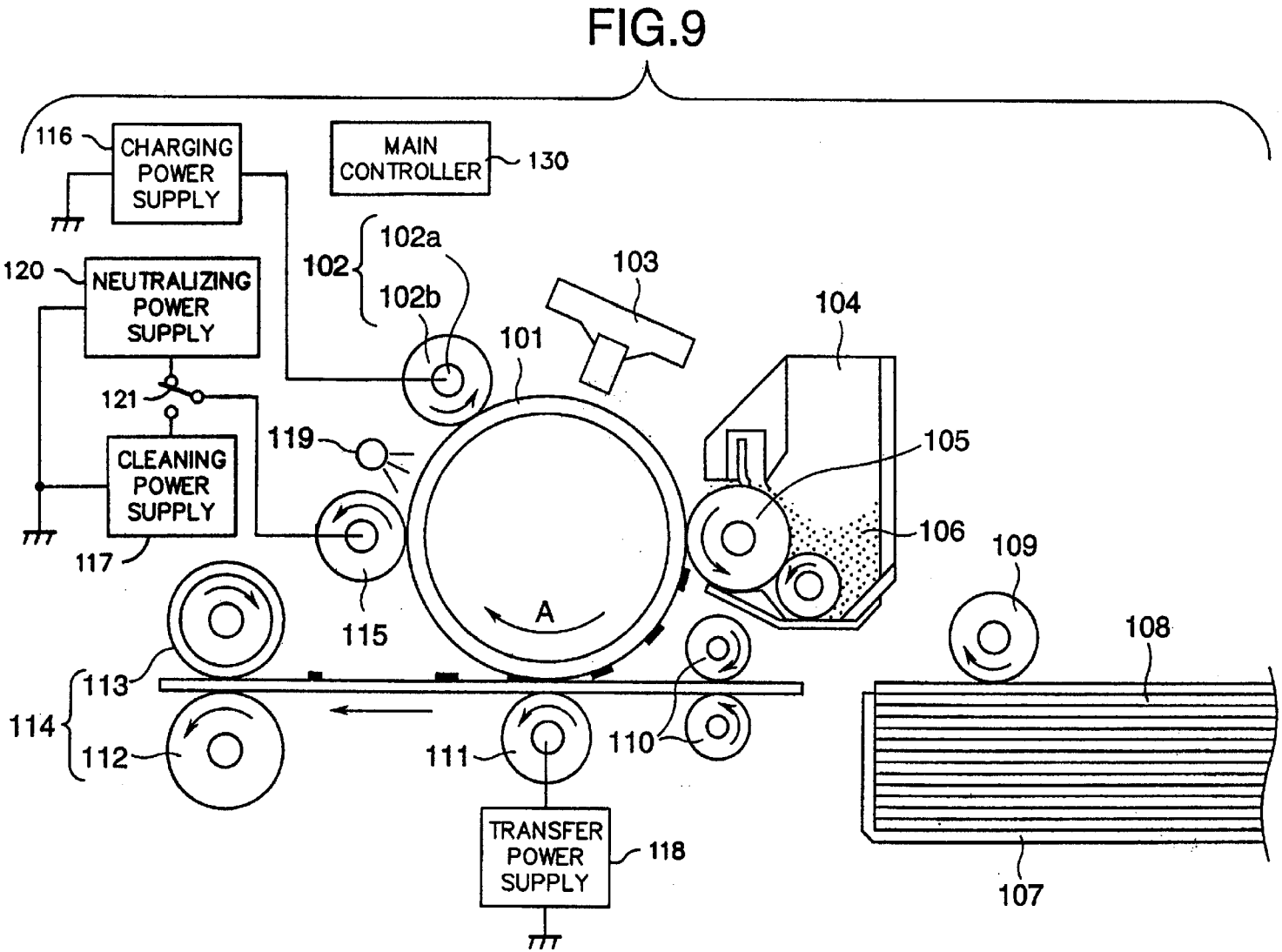
FIG. 9 illustrates a general construction of an image forming apparatus according to a fourth embodiment.

FIG. 9 illustrates a general construction of an image forming apparatus according to a fourth embodiment.

The fourth embodiment will be described with reference to FIG. 9.

The fourth embodiment differs from the third embodiment in that the neutralizing power supply 120 is connected to the cleaning roller 115 instead of the transfer roller 111. The cleaning roller 115 performs two functions: cleaning operation and neutralizing operation. The rest of the construction is the same as that of the third embodiment. The switch 121 is shifted in accordance with instructions received from the main controller 130.

<Operation>

The operation of the fourth embodiment will be described.

Upon receiving a drive signal, the main motor begins to drive the photoconductive drum 101 into rotation.

At the same time, the neutralizing power supply 120 applies an a-c voltage to the cleaning roller 115 to begin to neutralize the photoconductive drum 101. The neutralizing power supply 120 applies the a-c voltage to the photoconductive drum 101 for a period of time equivalent to two complete rotations of the charging roller 102. After this period, the neutralizing power supply 120 stops generating the a-c voltage while also shifting the switch 121 to the side of the cleaning power supply 117. From this time point onward, the cleaning power supply 117 applies a d-c voltage to the cleaning roller 115 for normal image forming operation.

As the photoconductive drum 101 rotates, an area in the surface of the photoconductive drum 101 neutralized by the cleaning roller 115 rotates to the contact region where the photoconductive drum 101 is in contact with the charging roller 102.

A predetermined delay time after the initiation of neutralization, the controller 116*b* begins to energize the charging roller 102 to charge the photoconductive drum 101, while also monitoring the detection output of the current detector 116*a*. The photoconductive drum 101 till the neutralized area rotates to the predetermined delay time is a length of time from when the cleaning roller 115 begins to neutralize an area of the surface of the charging roller 102. The delay time can be computed based on the rotational speed of the photoconductive drum 101 and the positional relations of the cleaning roller 115 and the charging roller 102 relative to rotation of the photoconductive drum 101.

The output current of the charging power supply 116 is set to −60 μA in order to charge the photoconductive drum to a desired potential. The controller 116*b* monitors the output voltage of the constant voltage circuit 116*c*. The controller 116*b* determines an average voltage of the output voltage of the constant voltage circuit 116*c* for a length of time corresponding to one complete rotation of the charging roller 102. This length of time is computed based on the peripheral speed and circumference of the charging roller 102.

Then, the controller 116*b* enters the CVC mode at a predetermined timing, thereby carrying out the normal image forming operation. The output voltage of the constant voltage circuit 116*c* is set to the aforementioned average voltage computed by the controller 116*b*.

In order to determine the advantages of the fourth embodiment, Experiments $4_1$ to $4_3$ were conducted using the apparatus according to the third embodiment. The five kinds of charging roller 102 were used which are the same Rollers I–V as were used in Experiments $1_1$ to $1_6$. Using the Rollers I–V, the recording speed and charging characteristic of the photoconductive drum were evaluated for four different recording speeds, i.e., 100, 150, 200, and 250 mm/sec. Table 10 lists the results. Symbol ○ indicates good charging while X indicates poor charging.

Experiment $4_1$

The image forming apparatus was left in an environment of 20° C. and 65%. Table 10 lists the results.

Experiment $4_2$

The image forming apparatus was left in an environment of 40° C. and 85%. Table 11 lists the results.

Experiment $4_3$

The image forming apparatus was left in an environment of 10° C. and 35%. Table 12 lists the results.

Tables 10–12 reveal that for the changes in environment and recording speed, the apparatus of the fourth embodiment has the same characteristics as Experiments $3_1$ to $3_3$ of the third embodiment.

The cleaning roller 115 is disposed downstream of the transfer roller 111 with respect to the rotation of the photoconductive drum 101 and upstream of the charging roller 102. Thus, the distance on the photoconductive drum from a position where the photoconductive drum is neutralized to a position where the photoconductive drum is charged by the charging roller 102 is shorter in the fourth embodiment than in the third embodiment. In other words, it takes a shorter time for the neutralized area on the surface of the photoconductive to reach the charging roller 102. The difference in time increases the number of recorded pages per unit time.

Generally speaking, the transfer roller 111 has a lower electrical resistance than the cleaning roller 115. The output voltage of the neutralizing power supply 120 can be decreased with decreasing resistance of the cleaning roller 115. The decreased resistance allows decreasing of the size and cost of the neutralizing power supply 120.

Fifth Embodiment

Figure 11:
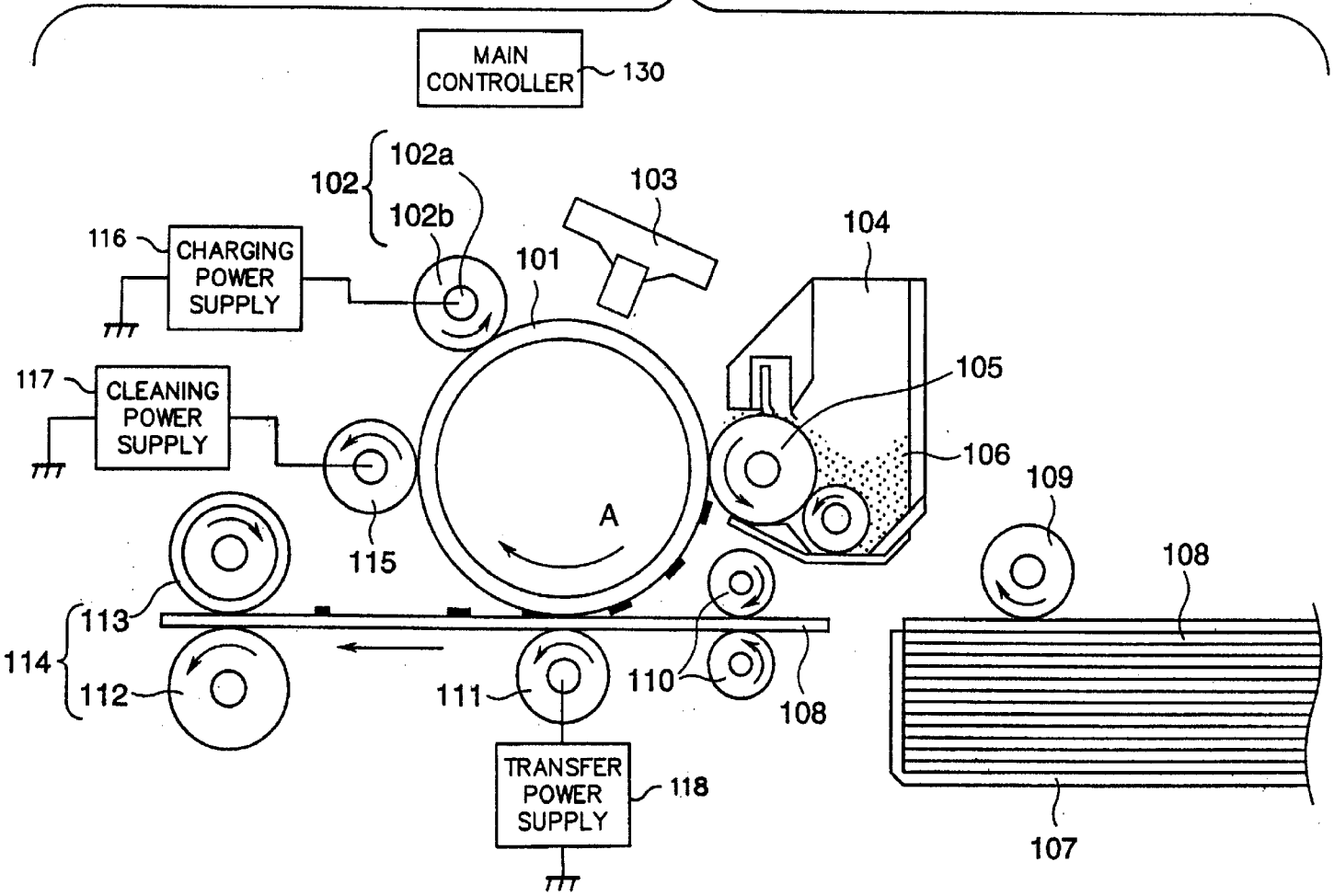
FIG. 11 illustrates a general construction of an image forming apparatus according to a fifth embodiment.

FIG. 11 illustrates a general construction of an image forming apparatus according to a fifth embodiment.

The fifth embodiment will be described with reference to FIG. 11.

The fifth embodiment differs from the third and fourth embodiments in that the exposing unit 103 is used to neutralize the photoconductive drum. Therefore, the neutralizing power supply 120 and the switch 121 shown in FIG. 9 are not used in the fifth embodiment. The rest of the construction is the same as that of the third and fourth embodiments.

<Operation>

The operation of the fifth embodiment will be described.

Upon receiving a drive signal, the main motor begins to drive the photoconductive drum 101 into rotation. At the same time, the exposing unit 103 illuminates the photoconductive drum 101 to completely neutralize the entire surface of the photoconductive drum. The light emitted from the exposing unit 103 dissipates the charged deposited on the surface of the photoconductive drum. As the photoconductive drum 101 rotates, a neutralized area on the surface of the photoconductive drum 101 rotates to the contact region where the photoconductive drum 101 is in contact with the charging roller 102.

After a predetermined delay time has elapsed after the initiation of neutralization, the controller 116*b* controls the charging power supply 116 to energize the charging roller 102, while also monitoring the detection result of the current detector 116*a*. The predetermined delay time is a length of time corresponding to a rotation of the surface of the photoconductive drum 1 from the exposing unit 103 to the charging roller 102. The predetermined delay time may be computed based on the rotational speed of the photoconductive drum 101 and the positions of the charging roller 102 and the exposing unit 103 relative to rotation of the photoconductive drum 101.

The output current of the charging power supply 116 is set to −60 $\mu$A in order to charge the photoconductive drum to a desired potential. The controller 116*b* monitors the output voltage of the constant voltage circuit 116*c*. The controller 116*b* determines an average voltage of the output voltage of the constant voltage circuit 116*c* for a length of time corresponding to one complete rotation of the charging roller 102. This length of time is computed based on the peripheral speed and circumference of the charging roller 102.

Then, the controller 116*b* enters the CVC mode at a predetermined timing, thereby carrying out the normal image forming operation. When the output voltage of the constant voltage circuit operates in the CVC mode, the output voltage of the constant voltage circuit 116*c* is set to the average voltage computed by the controller 116*b*.

In order to determine the advantages of the fifth embodiment, Experiments $5_1$ to $5_3$ were conducted using the apparatus according to the fifth embodiment. The five kinds of charging roller 102 were used which are the same Rollers I–V as were used in Experiments $1_1$ to $1_6$. Using the aforementioned five Rollers I–V, the recording speed and charging characteristic of the photoconductive drum were evaluated for four different recording speeds, i.e., 100, 150, 200, and 250 mm/sec. In Tables 13–15, the respect Symbol ○ indicates good charging while X indicates poor charging.

Experiment $5_1$

The image forming apparatus was left in an environment of 20° C. and 65%. Table 13 lists the results.

[0195] [0196]

Experiment $5_2$

The image forming apparatus was left in an environment of 40° C. and 80%. Table 14 lists the results.

Experiment $5_3$

The image forming apparatus was left in an environment of 10° C. and 35. Table 15 lists the results.

Tables 13–15 revealed that for the changes in environment and recording speed, the apparatus of the fifth embodiment has the same characteristics as Experiments $3_1$ to $3_3$ of the third embodiment.

The apparatus according to the fifth embodiment does not use the neutralizing power supply 120 and therefore is advantageous in reducing the manufacturing cost and miniaturizing the apparatus.

The aforementioned third to fifth embodiments may also be constructed as follows:

Although the charging roller 102 is in the form of semiconductive rubber roller, the charging device is not limited to the charging roller 102. The charging roller 102 can be replaced by, for example, a charging blade in the shape of a slab of semiconductive material, disclosed in Japanese Patent Preliminary Publication No. 2-264974, or a charging brush formed of semiconductive fiber disclosed in Japanese Patent Preliminary Publication No. 1-309076. Further, an endless semiconductive sheet or film may be used instead of the charging roller 102. Still another alternative is a blade that serves as a cleaning blade as well as a charging blade. Modifications can be made to the length of time during which the charging power supply 116 is operated in the CCC mode. The timings of switching the mode of operation of the charging power supply 116 and the neutralization of the photoconductive drum 101 may be modified. Another method may be used to compute an average value of a monitored output voltage of the constant voltage circuit.

Sixth Embodiment

A sixth embodiment will be described with reference to FIGS. 13–18.

The sixth embodiment is characterized in that the normal current in the CVC mode is detected, the output voltage (i.e., a voltage applied to the photoconductive drum 1) is adjusted in accordance with the detected normal current. Thus, the sixth embodiment allows stable, accurate controlling of the surface potential of the photoconductive drum 1.

Figure 13:
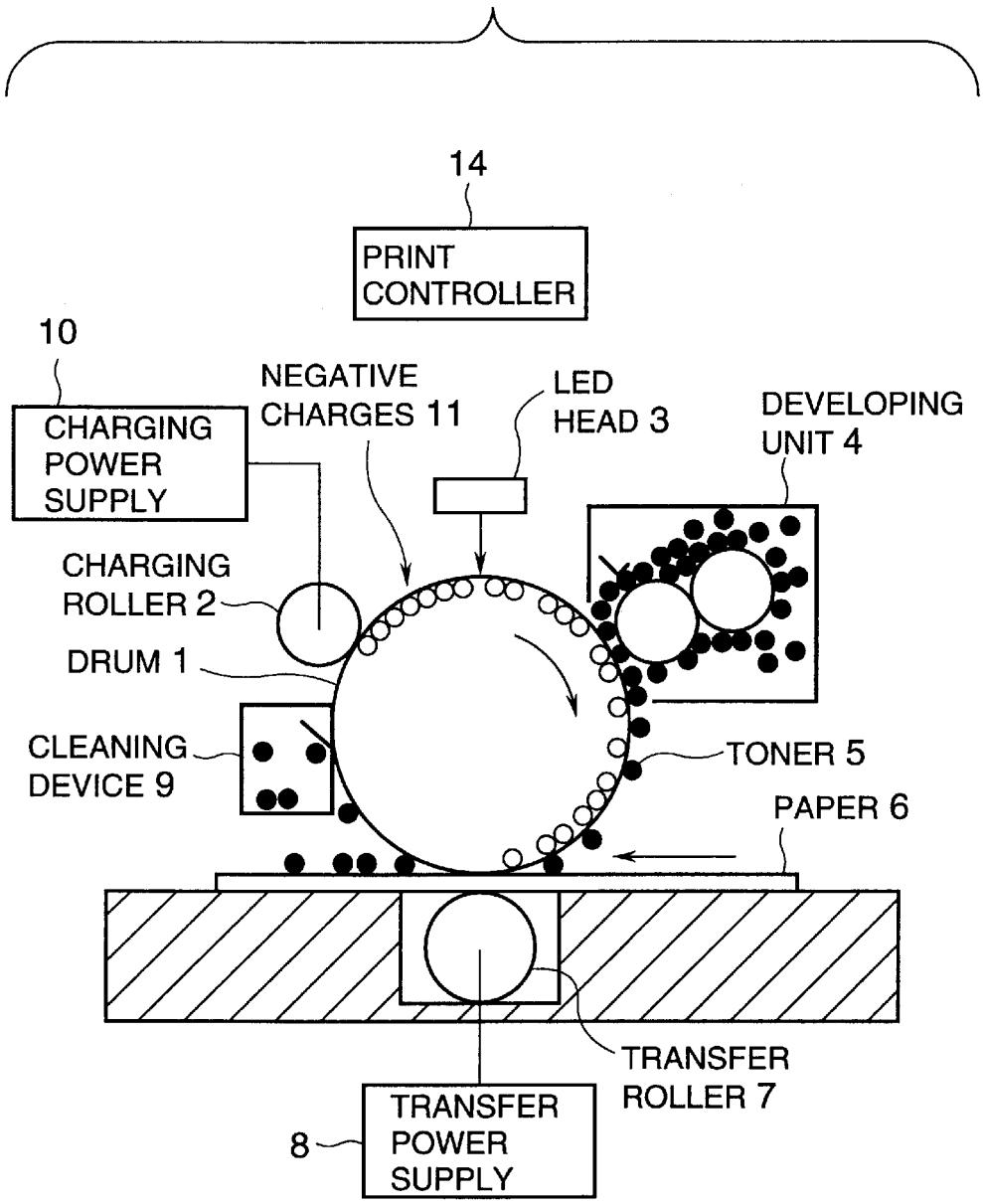
FIG. 13 illustrates a general construction of an image forming apparatus according to a sixth embodiment.

FIG. 13 illustrates a general construction of an image forming apparatus according to a sixth embodiment.

The general construction of the image forming apparatus will be described with respect to FIG. 13. The features of the apparatus will be described later with reference to FIGS. 14–18.

Referring to FIG. 13, a photoconductive drum 1 is rotatably supported. Disposed around the photoconductive drum 1 are a charging roller 2, a developing unit 4, a transfer roller 7, and a cleaning device 9. The charged surface of the photoconductive drum 1 is illuminated between the charging roller 2 and the developing unit 4.

The photoconductive drum 1 is rotated by a motor, not shown, during image forming process. The photoconductive drum 1 is of the same construction as the photoconductive drum 101 in the first embodiment, i.e., the photoconductive drum 1 includes a conductive support 101*a* and conductive layer 101*b*.

The charging power supply 10 applies a negative voltage to the charging roller 2 so that the charging roller 2 is negatively charged. The charging roller 2 is of the same construction as the charging roller 102 in the first embodiment, i.e., includes a metal shaft 102*a* and a semiconductive rubber layer 102*b*. The charging roller 2 in turn contacts the photoconductive drum 1 to negatively charge an area of the photoconductive drum in contact with the charging roller 2. The negative charges are depicted at reference numeral 11 in FIG. 13. The output voltage of the charging power supply 10 is controlled such that the surface potential of the photoconductive drum 1 is −800 V.

As the photoconductive drum 1 rotates, the negatively charged area rotates on the photoconductive drum 1 to a region where an LED head 3 illuminates the photoconductive drum 1. The LED head 3 emits light in accordance with print data and the light illuminates the charged surface of the photoconductive drum 1 to form an electrostatic latent image in accordance with the print data.

As the photoconductive drum 1 rotates, the area in which the electrostatic latent image is formed reaches the developing unit 4. The developing unit 4 applies toner to the photoconductive drum, thereby developing the electrostatic latent image with toner into a toner image.

The toner image then reaches the transfer point where the transfer roller 7 transfers the toner image to paper 6. The transfer roller 7 receives a positive voltage from the transfer power supply 8 so that an electric field is developed between the transfer roller 7 and the photoconductive drum 1. The Coulomb force produced by the electric field transfers the toner image.

Residual toner remaining on the photoconductive drum 1 is removed from the photoconductive drum 1 by the cleaning device 9.

As the photoconductive drum 1 rotates, the area on the surface of the photoconductive drum 1 cleaned by the cleaning device 9 returns to a region where the cleaned area again opposes the charging roller 2. The aforementioned sequence of operation is repeatedly carried out during printing operation.

The aforementioned operation is performed in accordance with instructions from the printer controller 14.

As described above, the printer controller 14 varies the output voltage (i.e., the voltage applied to the photoconductive drum 1) in accordance with the detection results (current) of the charging power supply 10, thereby accurately controlling the surface potential of the photoconductive drum 1 at a desired value. This feature is primarily implemented by the printer controller 14 and the charging power supply 10.

Figure 14:
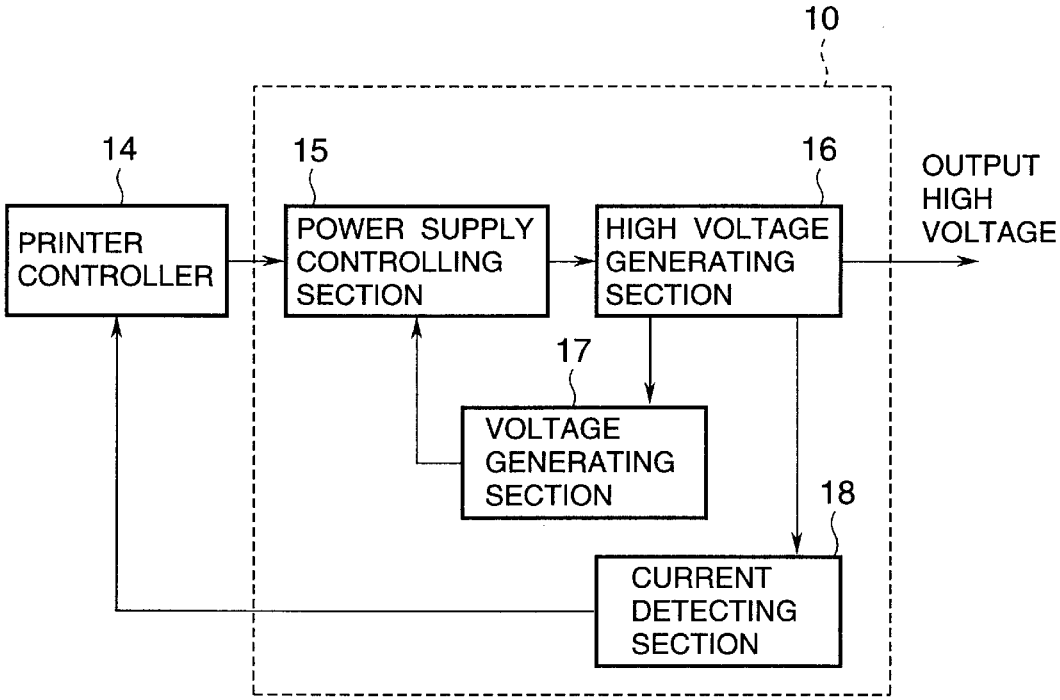
FIG. 14 is a block diagram illustrating the charging power supply and the printer controller.

FIG. 14 is a block diagram illustrating the charging power supply 10 and the printer controller 14.

Figure 15:
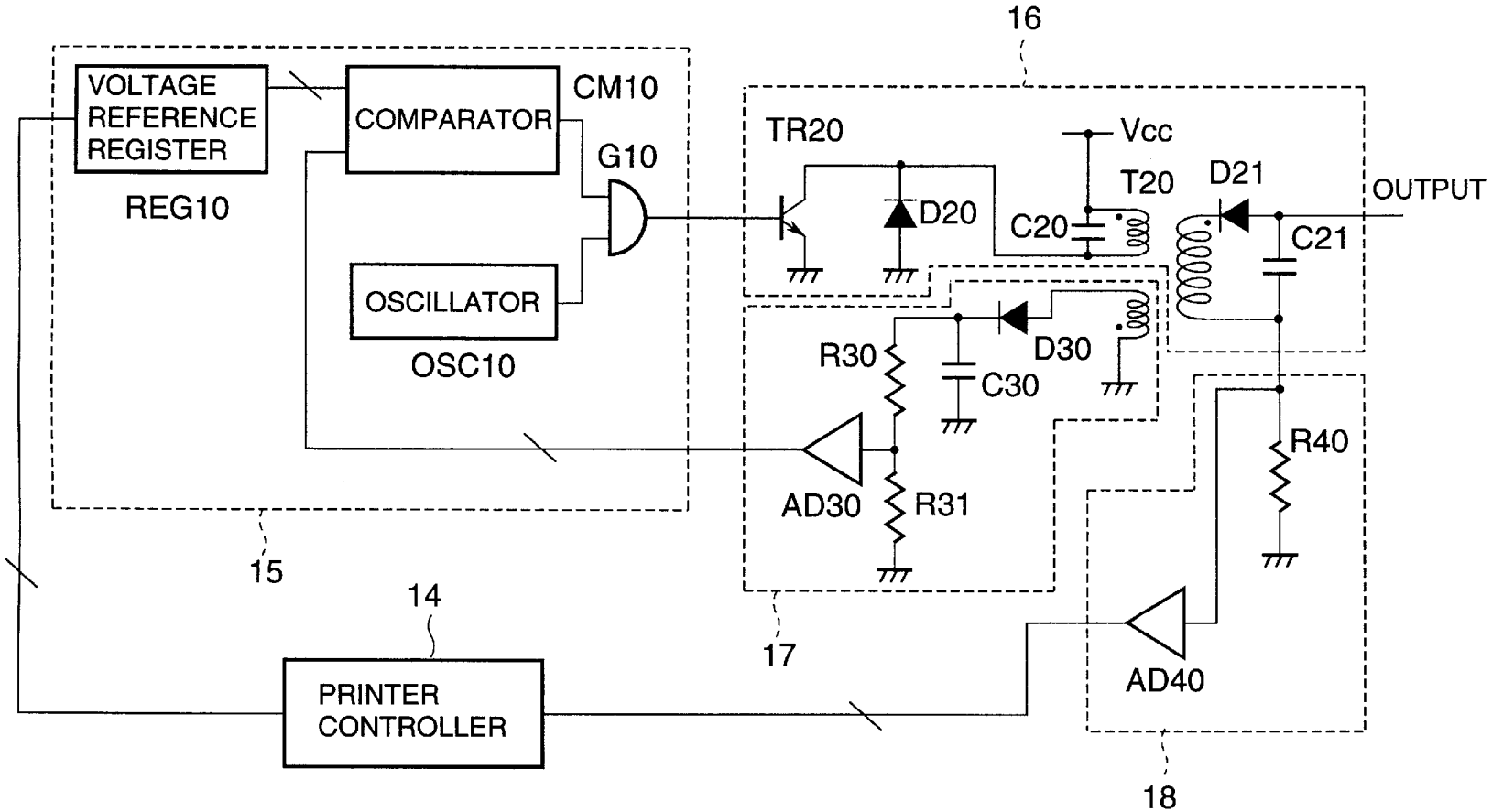
FIG. 15 illustrates a specific circuit configuration of the respective function blocks.

FIG. 15 illustrates a specific circuit configuration of the respective function blocks.

Referring to FIG. 14, the charging power supply 10 applies a voltage to the charging roller 2 in accordance with an instruction from the printer controller 14. The charging power supply 10 includes a power supply controlling section 15, high voltage generating section 16, voltage detecting section 17, and current detecting section 18.

The power supply controlling section 15 controls the high voltage generating section 16 in accordance with the instruction from the printer controller 14 and the detection result of the voltage detecting section 17, thereby maintaining the output voltage of the high voltage generating section 16 at a target voltage. Specifically, as shown in FIG. 15, the power supply controlling section 15 includes a voltage reference register REG10 connected to the printer controller 14, comparator CM10 in the form of a logic circuit that compares digital values, AND gate G10, and oscillator OSC10 that generates a square wave.

The high voltage generating section 16 generates and outputs a voltage that is applied to the charging roller 2. The high voltage generating section 16 includes a switching transistor TR20, diode D20 for protecting the transistor TR20, capacitor C20, high voltage transformer T20, rectifier diode D21, and smoothing capacitor C21.

The voltage detecting section 17 detects the voltage output of the high voltage generating section 16. The voltage detecting section 17 includes a part of the transformer T20, rectifier diode D30, capacitor C30, bleeder resistors R30 and 31, and A/D converter AD30.

The current detecting section 18 includes a resistor R40 connected to the transformer T20 and A/D converter AD40, and detects the current outputted from the high voltage generating section 16.

The printer controller 14 controls the overall operation of the image forming apparatus and includes a variety of control programs, memory in which the control programs are stored, CPU that executes the control programs, and logic circuits.

Figure 16:
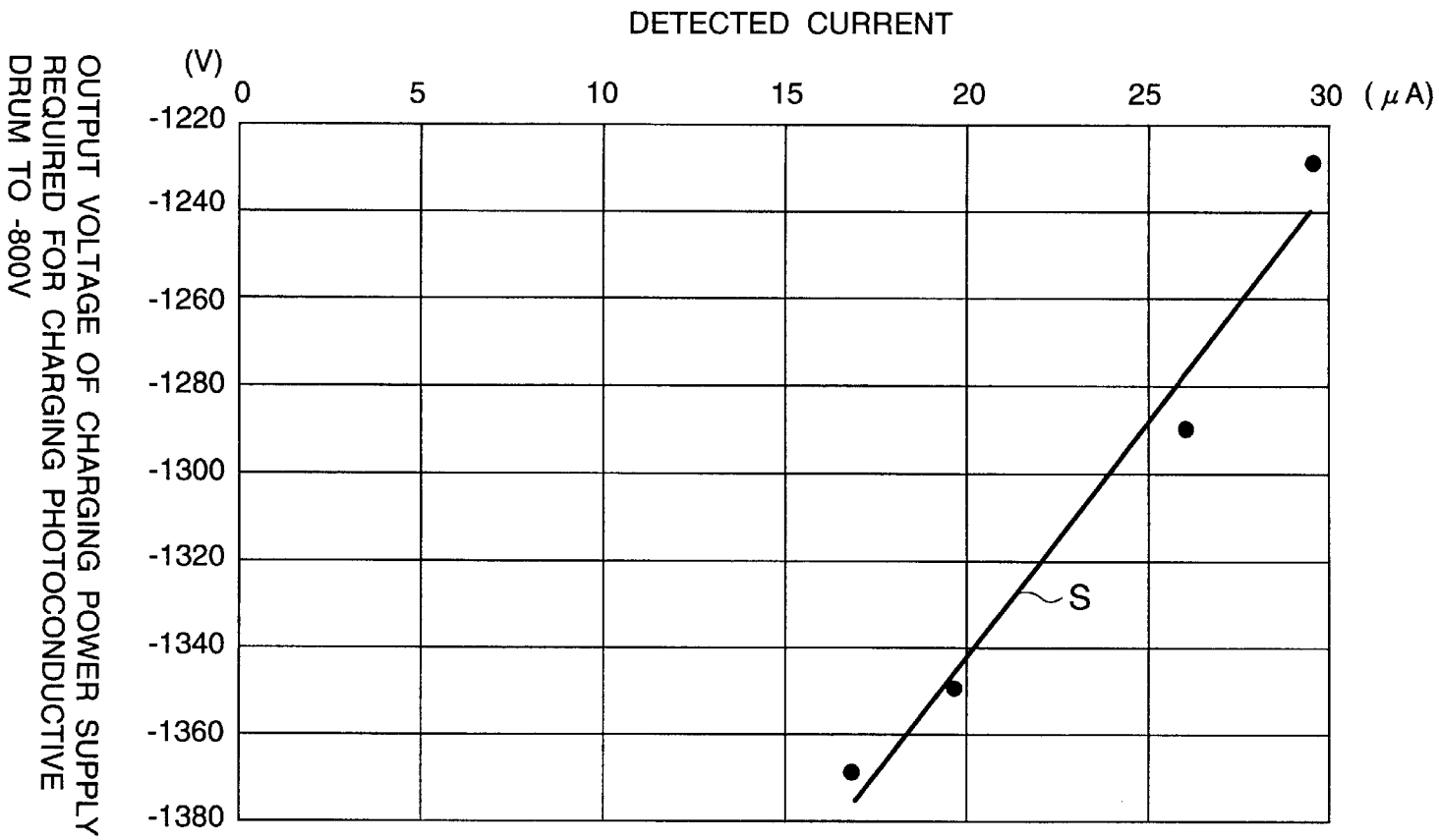
FIG. 16 is a graph that shows the relationship between the output voltage of the charging power supply and the corresponding detected current, the voltage being that required for charging the photoconductive drum to −800 V.

FIG. 16 is a graph that shows the relationship between the output voltage of the charging power supply and the corresponding detected current, the voltage being that required for charging the photoconductive drum to −800 V. As shown in FIG. 16, when the surface of the photoconductive drum is charged to −800 V, the output voltage of the charging power supply 10 and the current detected by the current detecting section 18 are substantially in a linear relation. Thus, the printer controller 14 of the sixth embodiment determines the output voltage of the charging power supply 10 on the basis of the detected current and the Line S. The memory of the printer controller 14 stores the output voltages and corresponding currents or a program (i.e., computing equation) for computing the output voltage from the line S.

<Operation of the printer controller>

The operation of the printer controller 14 will be described.

The printer controller 14 performs a preparatory operation immediately before printing, and this preparatory operation is referred to as warming up. During the warming-up state, the printer controller 14 provides an instruction to the charging power supply 10, instructing to output, for example, −1350 V.

The charging power supply 10 outputs a voltage of −1350 V in response to the instruction. The current detecting section 18 detects the current flowing back from the photoconductive drum 1 to the charging power supply 10 and transmits the current value to the printer controller 14.

The printer controller 14 determines a voltage necessary for setting the surface potential of the photoconductive drum to −800 V, by using the detected current value and Line S (or using the computing equation). The computed voltage value is written into the voltage reference register REG10 that resides in the power supply controlling section 15.

In the aforementioned manner, the high voltage generating section 16 outputs a voltage determined according to Line S so that the surface potential of the photoconductive drum may be controlled toward the desired value, i.e., −800 V.

<Operation of the charging power supply>

Figure 17:
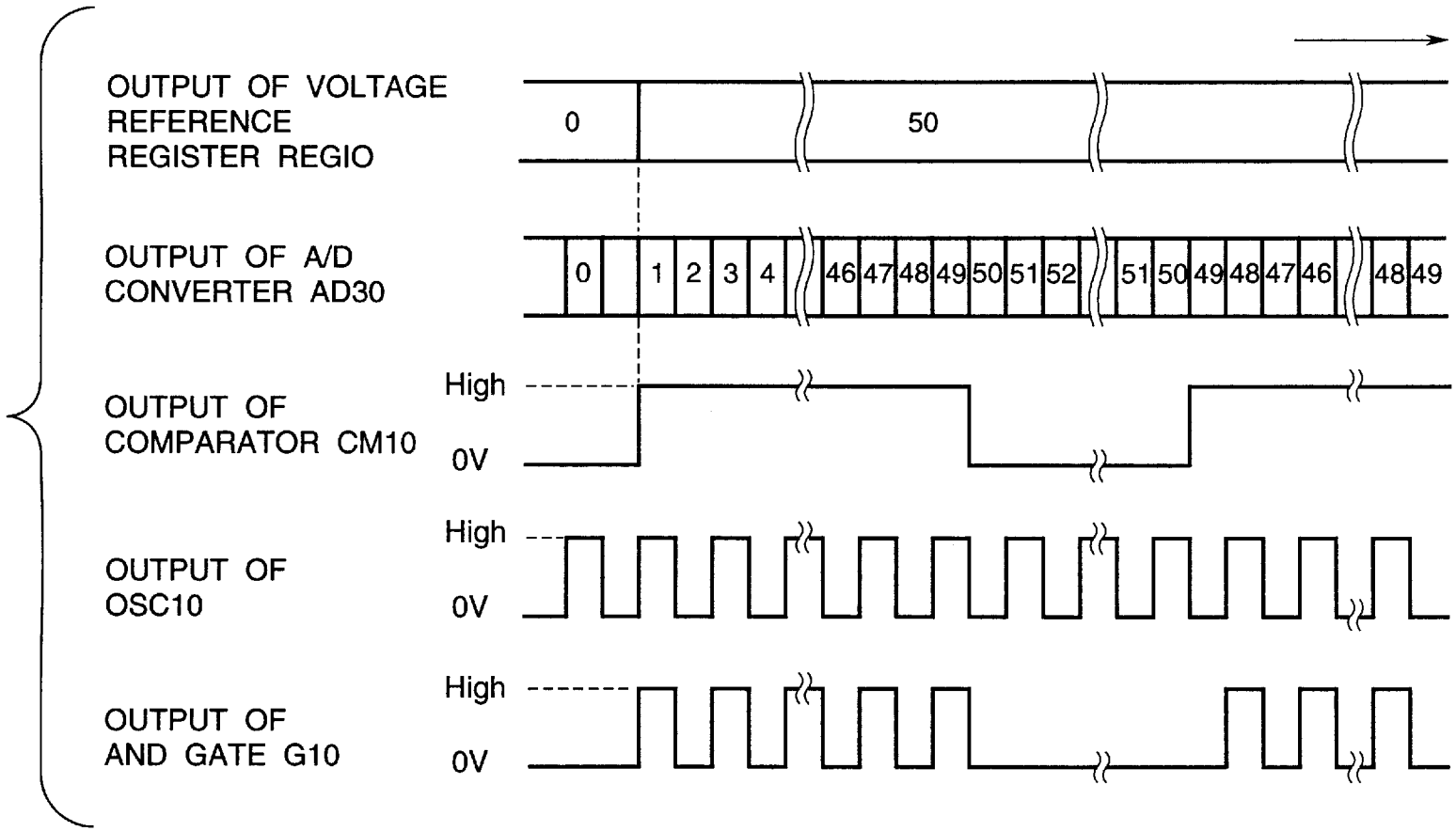
FIG. 17 is a timing chart illustrating the relationship between signals in the circuit of the charging power supply.

FIG. 17 is a timing chart illustrating the relationship between signals in the circuit of the charging power supply.

The operation of the charging power supply 10 will be described in detail with reference to FIGS. 15 and 17. The printer controller 14 writes a digital value, which specifies a desired voltage, into the voltage reference register REG10 in the power supply controlling section 15.

The power supply controlling section 15 generates a signal for controlling the high voltage generating section 16. In other words, as shown in FIG. 17, the comparator CM10 compares the digital value in the voltage reference register REG10 with the detection output of the current detecting section 17 (i.e., output of AD30). If the digital value in the voltage reference register REG10 is greater than the output of the A/D converter AD30 (digital value of REG10>the output of AD30 . . . Eq. (2)) the comparator outputs a logic 1 and if not a logic 0. The reference register REG10 is loaded with a reference value of, for example, "50". The comparator outputs "High" if the output of AD30 is smaller than "50" and "Low" if the output of AD30 is equal to or lager than "50".

The oscillator OSC10 outputs a square wave signal as shown in FIG. 17. The AND gate G10 takes a logical product of the outputs of the comparator CM10 and the oscillator OSC10, and then provides the comparison result as an instruction signal (pulse signal) to the high voltage generating section 16.

The instruction signal controls the transistor TR20 to turn on and off so that the high voltage generating section 16 generates a voltage in accordance with the instruction. Thus, an intermittent current flows through the transformer T20, thereby inducing a high voltage. The diode D21 and capacitor C21 cooperate with each other to rectify the induced high voltage, producing a negative d-c voltage which in turn is outputted to the charging power supply 10.

The diode D30 of the voltage detecting section 17 receives a voltage, which is determined by the ratio of turns of transformer T20. In other words, the voltage is proportional to the output of the high voltage generating section 16. The diode D30 and capacitor C30 cooperate to rectify the input voltage. The resistors R30 and R31 divide the rectified voltage across the capacitor C30. The A/D converter AD30 converts the divided voltage into a digital value, which in turn is sent to the comparator CM10 of the power supply controlling section 15. Thus, the output value of the A/D30 is determined by the ratio of turns of the transformer T20 and the ratio of resistance of R30 to that of R31. The output of the A/D converter AD30 is proportional to the output voltage of the high voltage generating section 16. The higher the output voltage is, the larger the digital value is.

The high voltage output of the high voltage generating section 16 causes a current to flow into the resistor R40 in the current detecting section 18, thereby developing a voltage drop across the resistor R40. The voltage drop is proportional to the current through the resistor R40. The A/D converter AD40 converts the voltage drop into a digital value, which in turn is outputted to the printer controller 14.

As mentioned above, the charging power supply 10 outputs a voltage whose value is written into the voltage reference register REG10 by the printer controller 14. The printer controller 14 receives a signal from the current detecting section 18, thereby detecting the value of a current being outputted from the charging power supply 10.

Since the output voltage of the charging power supply 10 is controlled in the sixth embodiment, the surface potential of the photoconductive drum 1 is not susceptible to changes in environmental conditions or variations of components surrounding the photoconductive drum 1. Thus, the surface potential of the photoconductive drum 1 may be controlled as close to a desired value (e.g., −800 V) as possible.

Figure 18:
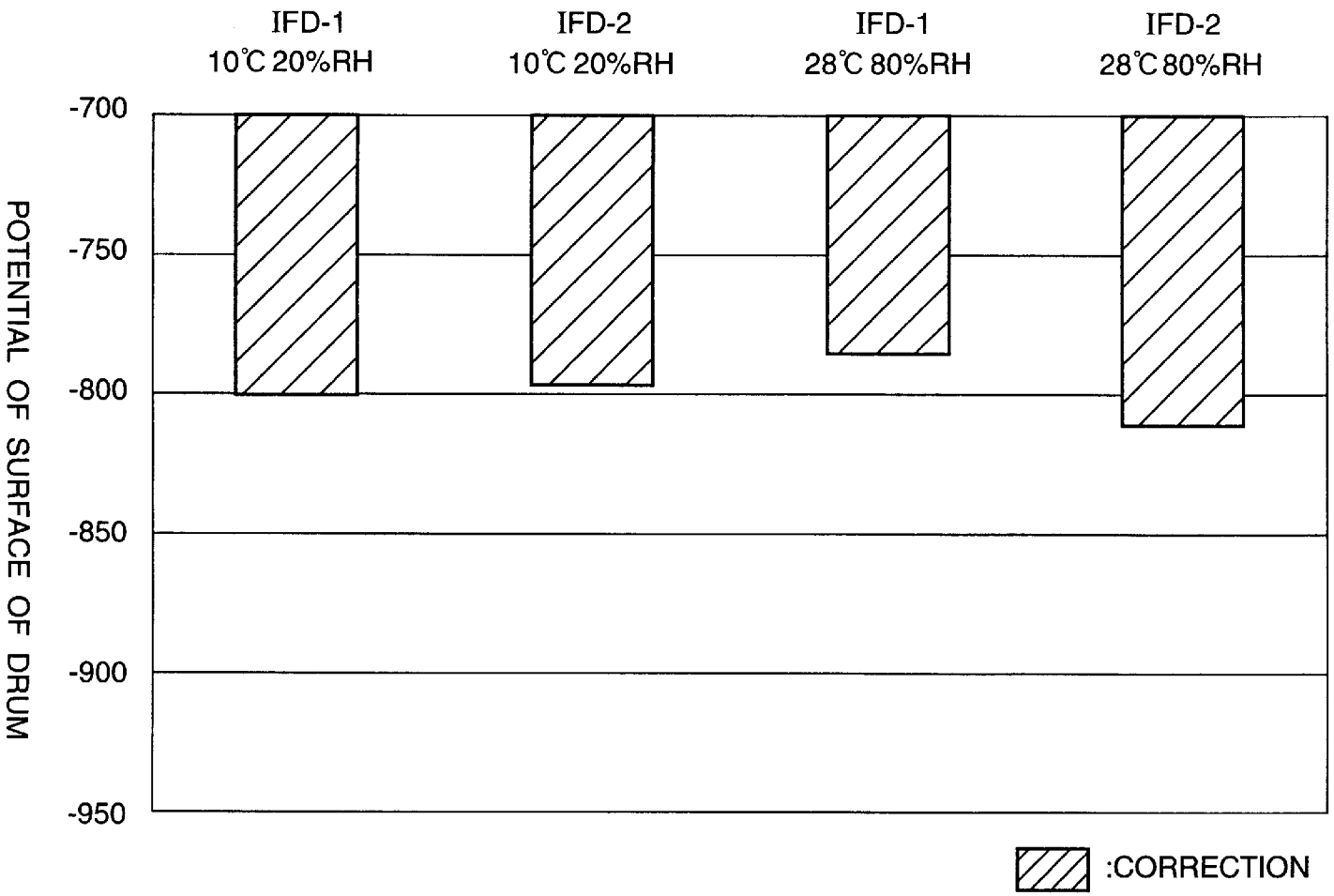
FIG. 18 shows measured surface potentials of the photoconductive drum 1 when the charging voltage is controlled according to the line S.

FIG. 18 shows measured surface potentials of the photoconductive drum 1 when the charging voltage is controlled according to line S. The results are close to the desired potential (i.e., −800 V). Stabilizing the surface potential of the photoconductive drum 1 minimizes the variations in the density of print output resulting from changes in environmental conditions. For example, stable surface potential of the photoconductive drum prevents soiling of the white portion of the paper due to poor charging of the photoconductive drum 1 which is encountered in the low-temperature and low-humidity environment. The sixth embodiment minimizes adverse effects on the surface potential of the photoconductive drum 1 resulting from variations in the capacitance of the photoconductive drum 1 and impedance of the charging roller 2. This increases the yield of the photoconductive drum 1 and charging roller 2, reducing the manufacturing cost.

Using the following methods may also set the output voltage of the charging power supply 10.

The ratio of an output current i detected by the monitor to a current io required for charging the photoconductive drum 1 to a desired voltage is computed. The ratio is multiplied by a desired potential. Then, the thus obtained product is added to the initial charging voltage of the photoconductive drum 1 to produce a target voltage.

In other words, the output voltage of the charging power supply 10 is given by Equation (3) as follows:

$$Vch=Vth+(Vs\times(io/i)) \quad (3)$$

where Vch (V) is a voltage of the charging power supply in the CVC mode, Vth (V) is an initial charging voltage of the photoconductive drum, Vs (V) is a target charging voltage of the photoconductive drum, io ($\mu$A) is a current required for charging the photoconductive drum to the target charging voltage, and i ($\mu$A) is a monitored current of the charging power supply before the charging power supply is controlled.

The charging power supply 10 is controlled in the CVC mode to output the target voltage.

While the value of Vth may be determined by experiment, Equation (4) may also be used to determine the value of Vth.

$$Vth=(7737.6\times(t/\epsilon))^{1/2}+312+6.2\times(t/\epsilon) \quad (4)$$

where t (m) is the thickness of the photoconductive layer 101*b* of the photoconductive drum 1 and $\epsilon$ is a relative dielectric constant of the photoconductive layer 101*b* of the photoconductive drum 1.

While the value of io may be determined by experiment, Equation (5) may also be used to determine the value of io.

$$io=(vp\times L\times\epsilon o\times\epsilon\times Vs)/t \quad (5)$$

where t (m) is the thickness of the photoconductive layer 101*b* of the photoconductive drum 1, $\epsilon$ is a relative dielectric constant of the photoconductive layer 101*b* of the photoconductive drum 1, vp (m/sec) is a peripheral speed of the photoconductive drum 1, L (m) is a longitudinal dimension of the semiconductive rubber layer 102*b* of the charging roller 102, Vs is a target charging voltage of the photoconductive drum 1, and $\epsilon o$ is dielectric constant in a vacuum.

<Determination of the output voltage of the charging power supply>

Figure 19:
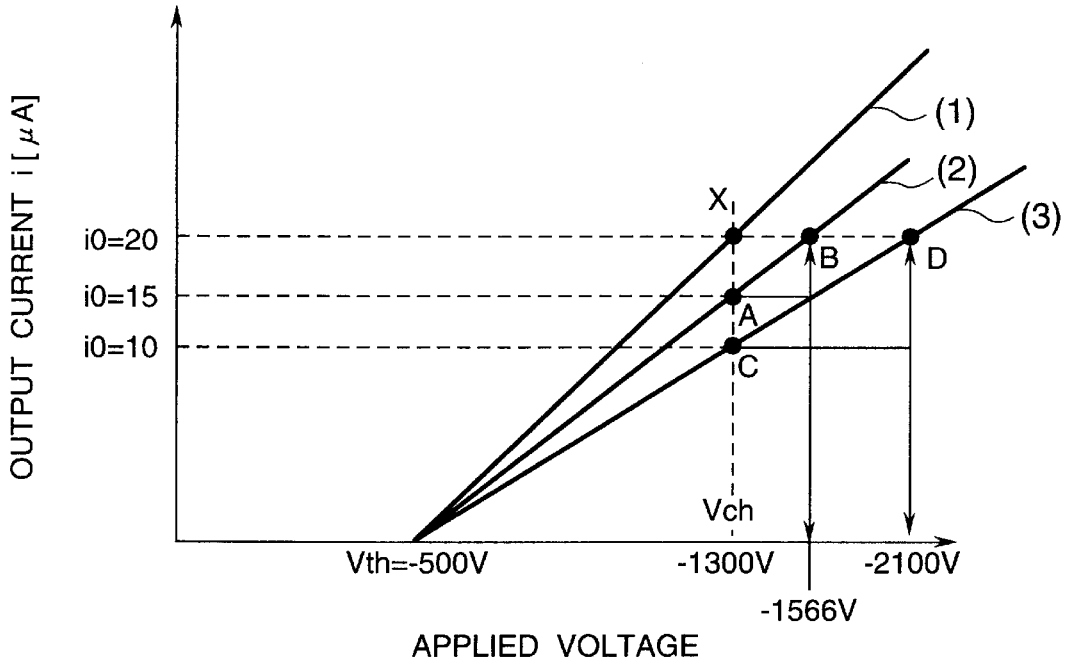
FIG. 19 illustrates the relationship between the charging voltage and current supplied to the charging roller.

FIG. 19 illustrates the relationship between the charging voltage and current supplied to the charging roller.

The determination of the output voltage of the charging power supply in the CVC mode will be described in more detail with reference to FIG. 19. Referring to FIG. 19, Line 1 shows an output voltage versus output current characteristic in a normal-temperature and normal-humidity environment, Line 2 shows a characteristic in a low-temperature and low-humidity environment, Line 3 shows characteristic in a high-temperature and high-humidity environment.

The charging power supply 10 outputs a voltage of −1300 V (=(−800 V)+(−500 V)) in the normal temperature and normal humidity environment, so that the photoconductive drum 1 is charged to the target voltage (i.e., −800 V) with an output current of 20 $\mu$A. Point X in FIG. 19 indicates this operating point.

The resistance of the charging roller 2 increases in the low-temperature and low-humidity environment and therefore the output voltage versus output current characteristic becomes that shown by Line 2. Therefore, even if the charging power supply outputs a voltage of −1300 V, the output current decreases to −15 $\mu$A, so that the photoconductive drum 1 is charged to a voltage below the target voltage (−800 V) as depicted at A in FIG. 19. In this case, charging is performed with an output voltage (−1566 V) of the charging power supply 10 computed by using Equation (3), so that the output current is −20 $\mu$A which charges the photoconductive drum 1 to the target voltage (−800 V). Point B in FIG. 19 indicates this operating point.

If the resistance of the charging roller 2 is high in the normal-temperature and normal-humidity environment and the output voltage versus output current characteristic may become that shown by Line 3. Therefore, even if the charging power supply 10 outputs a voltage of −1300 V, the output current decreases to −10 $\mu$A, so that the photoconductive drum 1 is charged to a voltage below the target voltage (−800 V) as depicted at "C" in FIG. 6. In this case, charging is performed with an output voltage (−2100 V) of the charging power supply 10 computed by using Equation (3), so that the output current is 20 $\mu$A which charges the photoconductive drum 1 to the target voltage (−800 V). Point D in FIG. 19 indicates this operating point.

In addition to the control of the output voltage of the charging power supply, it is desirable to neutralize an area of the surface of the photoconductive drum upstream of the charging roller. If some charges remains on the photoconductive drum 1 when the output current is monitored, the charges remaining on the photoconductive drum 1 adversely affects the monitored result. A neutralizing means may be in the form of a transfer unit, cleaning roller, or light exposing device as shown in the present embodiment and the previously described other embodiments.

Seventh Embodiment

A seventh embodiment will be described with reference to FIGS. 20 and 21.

Figure 20:
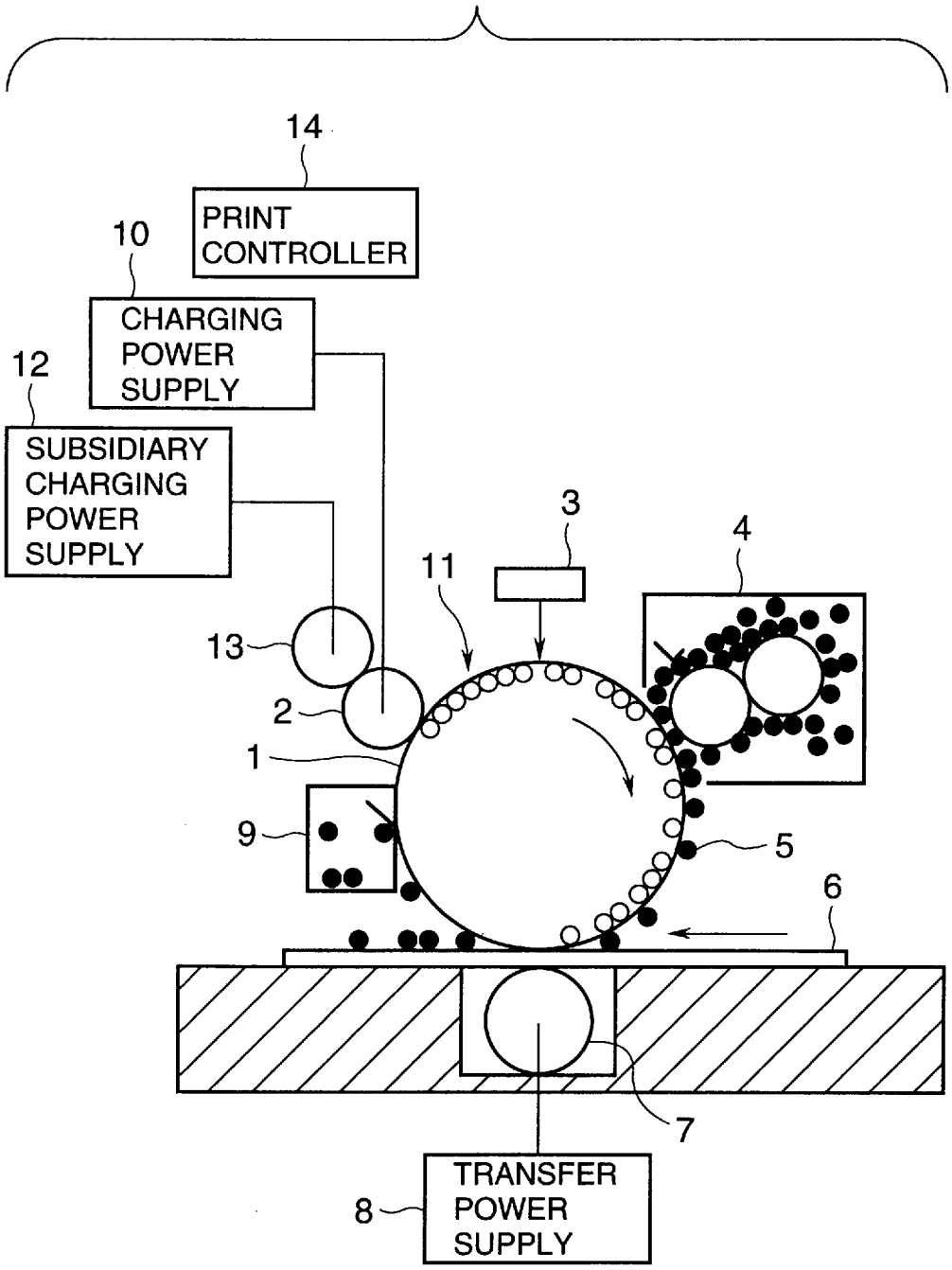
FIG. 20 illustrates a general construction of an image forming apparatus according to a seventh embodiment.

FIG. 20 illustrates a general construction of an image forming apparatus according to a seventh embodiment.

Figure 21:
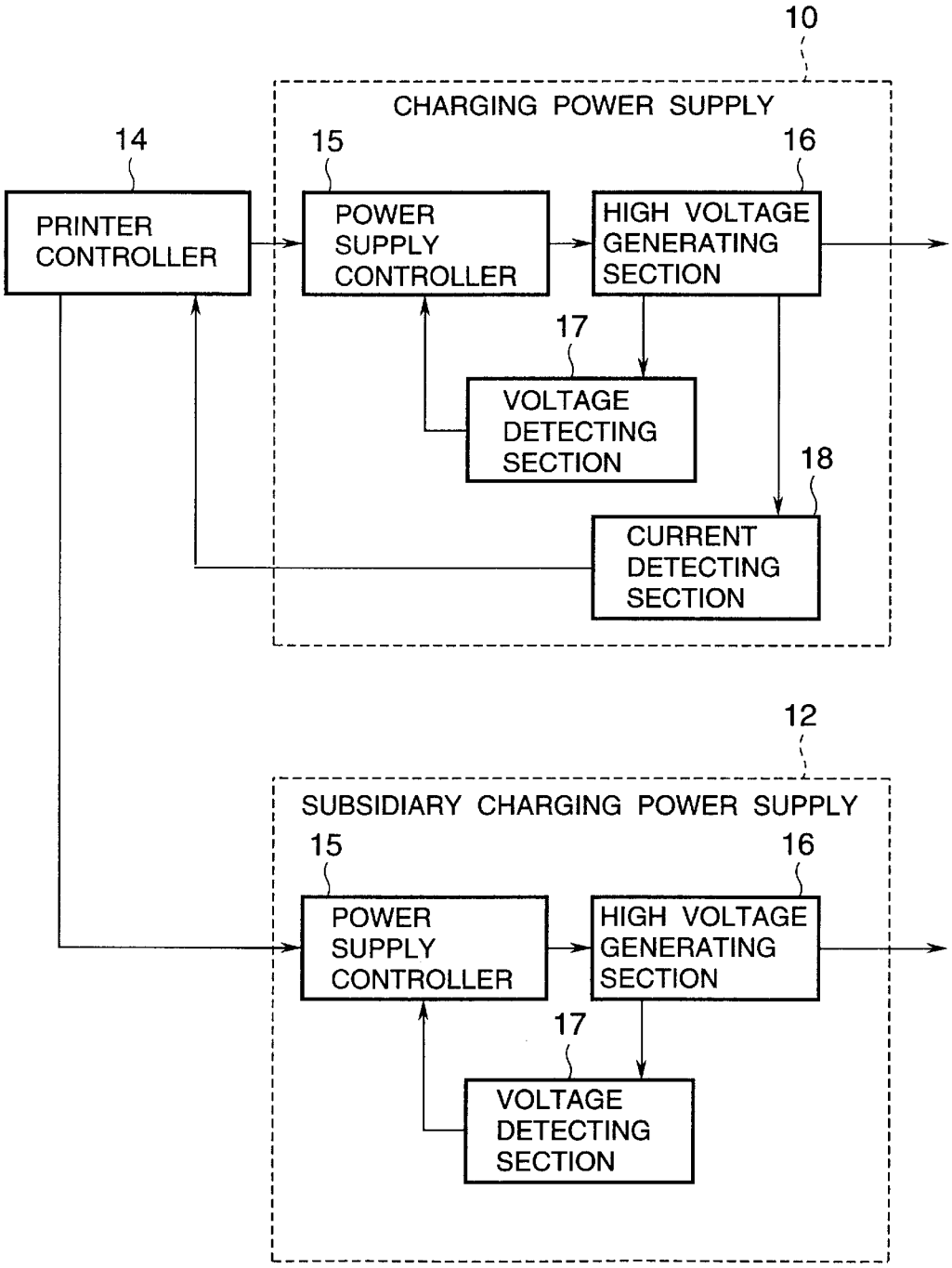
FIG. 21 is a block diagram illustrating the charging power supply.

FIG. 21 is a block diagram illustrating the charging power supply 10.

With a conventional printer, toner remaining on a photoconductive drum after transferring is scratched off the photoconductive drum by a cleaning device. However, it is rather difficult to thoroughly remove the toner and the residual toner on the photoconductive drum causes the surface potential of the photoconductive drum to decrease. In other words, the charged potential of the surface of the photoconductive drum becomes unstable depending on the amount of toner remaining on the photoconductive drum.

The seventh embodiment is primarily characterized in that a later described means is provided to remove the toner deposited on the charging roller 2, so that less toner remains on the charging roller 2 to ensure stable charging of the photoconductive drum. Specifically, the seventh embodiment is provided with an subsidiary charging power supply 12 and an subsidiary charging roller 13 in addition to the construction of the sixth embodiment.

As shown in FIG. 20, the subsidiary charging roller 13 is a driven roller that is in intimate contact with the charging roller 2 and is driven in rotation when the charging roller 2 rotates. The subsidiary charging roller 13 is made of a metal and has an axial length equal to or greater than that of the charging roller 2. The subsidiary charging roller 13 receives a necessary voltage from the subsidiary charging power supply 12.

The subsidiary charging power supply 12 is of the same construction as the charging power supply 10 of the sixth embodiment except that the subsidiary charging power supply 12 has not a current detecting section 18. The output voltage of the subsidiary charging power supply 12 is set in accordance with an instruction from the printer controller 14.

The subsidiary charging power supply 12 applies the voltage to the subsidiary charging roller 13 at the same timing that the charging power supply 10 applies the voltage to the charging roller 2. The output voltage of the subsidiary charging power supply 12 is equal to or larger in absolute value than that of the charging power supply 10.

The printer controller 14 determines the output voltages of the charging power supply 10 and subsidiary charging power supply 12 and causes the power supplies 10 and 12 to output the corresponding output voltages, respectively.

<Operation #1>

The operation of the seventh embodiment will be described with respect to a case where when an image is formed, the subsidiary charging roller 13 and the charging roller 2 receive a voltage of the same value.

When the printer is warmed up, the printer controller 14 sends instructions to the charging power supply 10 and subsidiary charging power supply 12 so that the power supplies 10 and 12 output a voltage of, for example, −1350 V. The current detecting section 18 of the charging power supply 10 detects the current flowing back from the photoconductive drum 1 into the charging power supply 10. Then, in a similar manner to the sixth embodiment, the printer controller 14 determines on the basis of the detected current and line S of FIG. 16 the output voltages of the charging power supply 10 and the subsidiary charging power supply 12 for image forming process.

During the image forming process, the charging power supply 10 and subsidiary charging power supply 12 outputs a voltage of the aforementioned same value according to the line S shown in FIG. 16.

Both during the warming up state and the image forming process, the subsidiary charging roller 13 is driven in rotation by the charging roller 2. As a result, the toner deposited on the charging roller 2 migrates to the subsidiary charging roller 13. In other words, an amount of toner deposited on the charging roller 2 decreases. In response to the instruction from the printer controller 14, the subsidiary charging power supply 12 provides the same voltage as the charging power supply 10 to the subsidiary charging roller 13 at the same timing. Thus, subsidiary charging roller 13 does not adversely affect the charging of the photoconductive drum 1 when the photoconductive drum 1 is charged by the charging roller 2.

The larger the surface area of the subsidiary charging roller 13, the more toner is deposited. The toner deposited on the charging roller 2 migrates to the subsidiary charging roller 13. The seventh embodiment has the same advantages as the sixth embodiment and is an additional advantage that since less toner is deposited on the charging roller 2, the surface of the photoconductive drum 1 is charged with good stability.

<Operation #2>

The operation of the seventh embodiment will be described with respect to a case where the subsidiary charging roller receives a higher voltage (absolute voltage) than the charging roller during image forming process.

When the printer is warmed up, the printer controller 14 sends instructions to the charging power supply 10 and subsidiary charging power supply 12 so that the power supplies 10 and 12 output a voltage of, for example, −1350 V. The current detecting section 18 of the charging power supply 10 detects the current flowing back from the photoconductive drum 1 into the charging power supply 10. Then, the printer controller 14 determines the output voltage of the charging power supply 10 by using the detected current and Line Sc1 of FIG. 22, and the output voltage of the subsidiary charging power supply 12 by using the detected current and Line Ss1 of FIG. 22.

Figure 22:
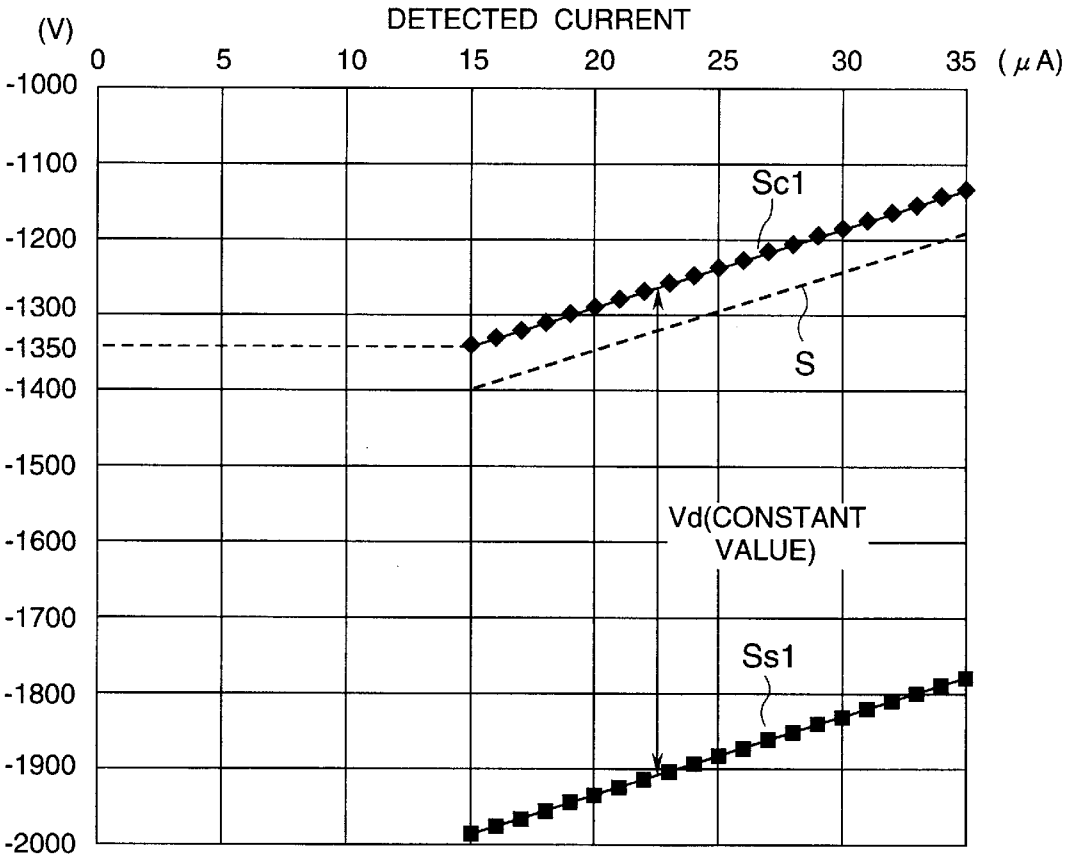
FIG. 22 is a graph that shows the relationship between the output voltage of the charging power supply and the corresponding detected current, and the relationship between the output voltage of the subsidiary charging power supply and the corresponding detected current.

FIG. 22 is a graph that shows the relationship between the output voltage of the charging power supply 10 and the corresponding detected current, and the relationship between the output voltage of the subsidiary charging power supply 12 and the corresponding detected current. FIG. 22 also shows Line S used in the sixth embodiment. The output voltages are those required for charging the surface of the photoconductive drum to −800 V.

If the subsidiary charging power supply is not used (e.g., sixth embodiment) or the charging power supply 10 and subsidiary charging power supply 12 outputs the same voltage, one specific detected current corresponds to only one specific output voltage that charges the surface of the photoconductive drum 1 to −800 V.

However, if the output voltage of the subsidiary charging power supply 12 is selected to be larger in absolute value than the output voltage of the charging power supply 10, then there exist a plurality of combinations of output voltages that charge the surface of the photoconductive drum to −800 V.

In other words, there exist a plurality of combinations of Line Sc1 and Line Ss1. FIG. 22 shows one of the combinations which is used in the seventh embodiment.

The differences Vd between values on Line Sc1 and Line Ss1 are a predetermined fixed value and independent of the detected current. Referring to FIG. 22, the difference Vd is 650 V and Line Sc1 and Line Ss1 are parallel to each other. It is to be noted that Line Sc1 is closer to 0 volts than Line S (sixth embodiment) and Line Sc1 is parallel with Line S. This is because the subsidiary charging roller 13 is more negative than the charging roller 2 and therefore the potential of the charging roller 2 is affected by the subsidiary charging roller 13.

During the image processing operation, the charging power supply 10 outputs a negative voltage according to Line Sc1 of FIG. 22 and the subsidiary charging power supply 12 outputs another negative voltage according to Line Ss1 of FIG. 22. The absolute value of the negative output voltage of the subsidiary charging power supply 12 is 650 V larger than that of the charging power supply 10. For example, when the output voltage of the charging power supply 10 is −1350 V, the output voltage of the subsidiary charging power supply 12 is −2000 V.

During the image processing operation, the subsidiary charging roller 13 receives a more negative voltage than the charging roller 2 and is driven by the charging roller 2. As a result, the toner deposited on the charging roller 2 migrates to the subsidiary charging roller 13 and is negatively charged. Thus, negatively charged toner is removed from the charging roller 2 and subsidiary charging roller 13 with the result that less toner remains on the charging roller. The subsidiary power supply 12 and charging power supply 10 provide output voltages to the subsidiary charging roller 13 and the charging roller 2, respectively, so that the surface of the photoconductive drum 1 is charged to −800 V. Thus, the subsidiary charging roller 13 does not adversely affect the charging of the photoconductive drum 1 by the charging roller 2.

As a result, the toner deposited on the charging roller 2 migrates to the subsidiary charging roller 13. Thus, an amount of toner remaining on the charging roller decreases. Since the subsidiary charging roller 13 is more negative than the charging roller 2, the toner deposited on the charging roller 2 is negatively charged at an area in contact with the subsidiary charging roller 13. Thus, the negatively charged toner is easily removed from the charging roller. As a result, less toner migrates to the subsidiary charging roller 13 and less toner remains on the charging roller 2 after the area in contact with the subsidiary charging roller rotates away from the subsidiary charging roller 13.

In other words, the potential difference Vd between the subsidiary charging roller 13 and the charging roller 2 reduces an amount of toner remaining on the charging roller 2. The larger the potential difference Vd is, the less toner remains on the charging roller 2. Therefore, less toner remains on the charging roller 2. In addition to the advantages of the sixth embodiment, the seventh embodiment has an advantage that the surface potential of the photoconductive drum 1 is stable.

Lines Sc1 and Ss1 of FIG. 22 may be determined as follows:

A plurality of printers having the image forming devices with manufacturing variations were placed in different environments. Currents were detected which were supplied to the photoconductive drum 1 when the charging power supply 10 and subsidiary charging power supply 12 output a voltage of −1350 V.

Then, for a printer placed in one of the environments, the output voltages of the subsidiary charging power supply 12 and charging power supply 10 were varied so that the surface of the photoconductive drum 1 is charged to −800 V. For various differences between the output voltages of the subsidiary charging power supply 12 and charging power supply 10, changes in the amount of toner remaining on the charging roller 2 were tested. The potential difference Vd between the subsidiary charging power supply 12 and charging power supply 10, i.e., the difference between Line Sc1 and Line Ss1 is determined so that residual toner on the photoconductive drum 1 is minimized.

Next, a combination of the output voltages of the charging power supply 10 and subsidiary charging power supply 12 was determined for each printer in a corresponding environment, the output voltages being such that the photoconductive drum 1 is charged to −800 V. Thus, the relationship between the detected current and a combination of output voltages having a difference of Vd, i.e., Line Sc1 and Line Ss1 of FIG. 22 was obtained.

In order that there is a potential difference Vd between the subsidiary charging roller 13 and charging roller 2, the printer controller 14 determines the output voltages of the charging power supply 10 and subsidiary charging power supply 12 on the basis of the detection result of the current detecting section 18 and Line Sc1 and Line Sc1. Data or program (i.e., formula) that describes Lines Sc1 and Ss1 is stored in a memory of the printer controller 14.

Eighth Embodiment

An eighth embodiment differs from the seventh embodiment in that the difference Vd in potential between the subsidiary charging roller 13 and the charging roller 2 is varied in accordance with the detected current.

When the printer operates in a high temperature and high humidity environment, the charging roller 2 tends to attract toner and has more toner deposited thereon. The detected current will also become large in the high temperature and high humidity environment. Moreover, the larger the difference in potential Vd is, the less toner is deposited on the charging roller 2.

Therefore, the potential difference between the subsidiary charging roller 13 and charging roller 2 during the image forming process is made progressively large with increasing detected current, so that the increased potential difference improves the efficiency in removing toner deposited on the charging roller 2.

<Operation>

The operation of the eighth embodiment will be described.

When the printer is warmed up, the printer controller 14 provides an instruction to the charging power supply 10 and subsidiary charging power supply 12 so that the two power supplies 10 and 12 output a voltage of −1350 V. The current detector 18 of the charging power supply 10 detects a current that flows back from the photoconductive drum 1 into the charging power supply 10. The printer controller 14 determines values of the output voltages of the charging power supply 10 and the subsidiary charging power supply 12 according to Lines Sc2 and Ss2, respectively, shown in FIG. 23.

Figure 23:
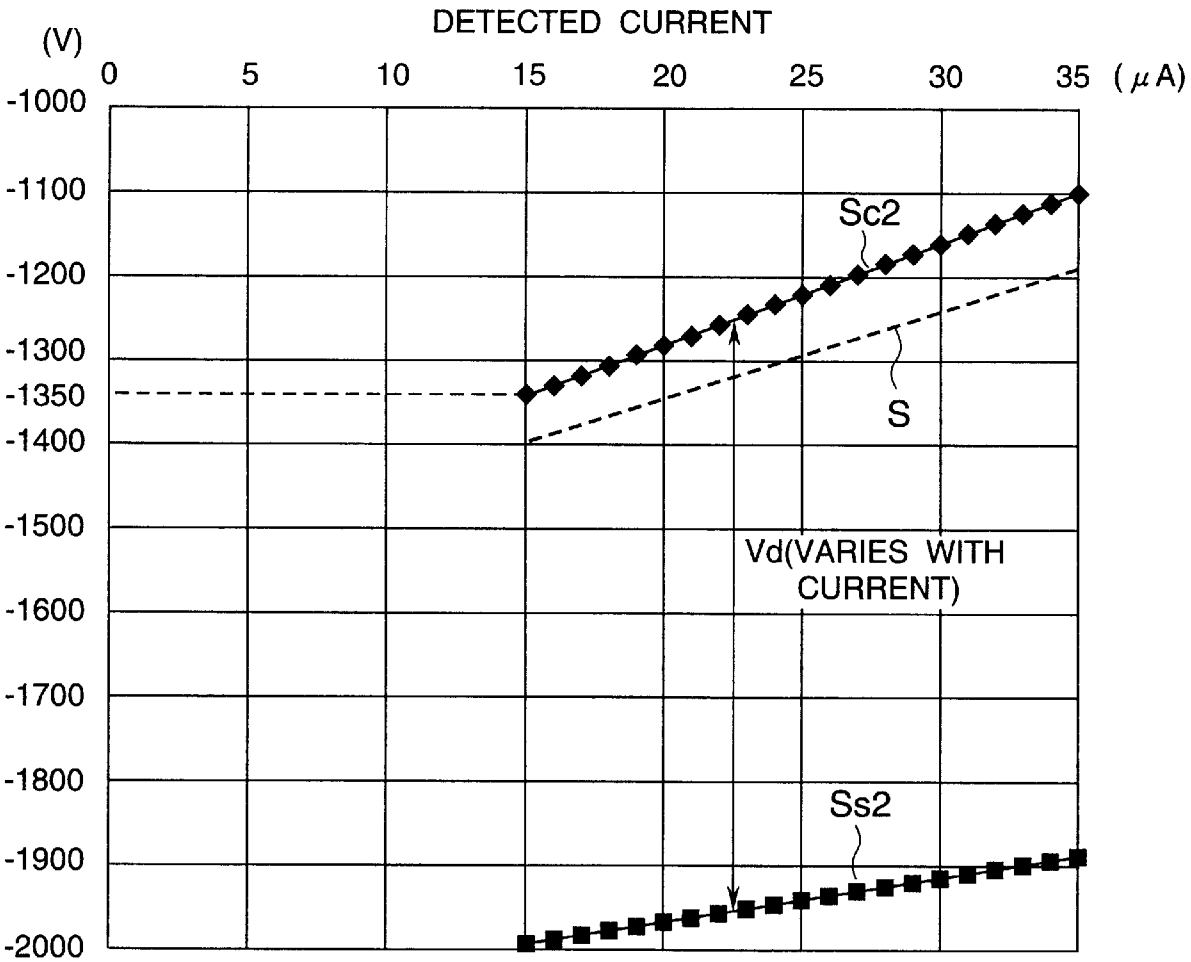
FIG. 23 shows graphs illustrating the relationship between detected currents and corresponding output voltages of the charging power supply and subsidiary charging power supply according to an eighth embodiment.

FIG. 23 shows graphs illustrating the relationship between detected currents and corresponding output voltages of the charging power supply 10 and subsidiary charging power supply 12, the output voltages being those required for charging the surface of the photoconductive drum 1 to −800 V. FIG. 23 also shows Line S of the sixth embodiment (FIG. 16).

Just as in the seventh embodiment, if the output voltage of the subsidiary charging power supply 12 is selected to be larger in absolute value than the output voltage of the charging power supply 10, then there exist a plurality of combinations of output voltages for one specific detected current. The output voltages are those required for charging the surface of the photoconductive drum 1 to −800 V. In other words, there are a plurality of combinations of Line Sc1 and Line Sc1. FIG. 23 shows one of the combinations, which is used in the eighth embodiment.

A combination used in the eighth embodiment is one in which the potential difference Vd between the outputs of the charging power supply 10 and the subsidiary charging power supply 12 is in a linear relation such that potential difference Vd becomes progressively large with increasing detected current. It is to be noted that the distance between Lines Sc2 and Ss2 increases with increasing detected current. This is because the subsidiary charging roller 13 is at a more negative potential than the charging roller 2 and the potential of the subsidiary charging roller 13 affects that of the charging roller 2.

During the image forming process, the charging power supply 10 and the subsidiary charging power supply 12 generate negative voltages according to Line Sc2 and Line Ss2, respectively.

The subsidiary charging roller 13 is rotated as the charging roller 2 rotates. Then, the toner deposited on the charging roller 2 migrates to the subsidiary charging roller 13 and is negatively charged by the negative potential of the subsidiary charging roller 13. Then, the negatively charged toner is removed from the charging roller 12 and subsidiary charging roller 13. In this manner, less toner remains deposited on the charging roller 2.

The potential difference Vd between the charging roller 2 and the subsidiary charging roller 13 causes the toner in the contact region between the charging roller 2 and subsidiary charging roller 13 to be charged, so that the toner is easily removed. When more toner is deposited on the charging roller 2 due to increased detected current in the high temperature and high humidity environment, the potential difference Vd increases, so that the subsidiary charging roller 13 becomes more effective in removing the residual toner.

In addition to the advantages of the sixth embodiment, the seventh embodiment provides a stable surface potential of the photoconductive drum 1 since less toner remains on the charging roller 2. It is to be noted that even if the potential difference Vd is increased as the detected current increases, the absolute values of the voltages applied to the subsidiary charging roller 13 and charging roller 2 become small (FIG. 23).

<Determination of Line Sc2 and Ss2>

Lines Sc2 and Ss2 are determined as follows:

A plurality of printers having variations in the image forming device were placed in different environments. For each printer, a current supplied to the photoconductive drum 1 was detected when the charging power supply 10 and subsidiary charging power supply 12 output a voltage of −1350 V.

Then, the environment in which one of the printers was placed was changed, and the output voltages of the subsidiary charging power supply 12 and charging power supply 10 were varied in each environment so that the surface of the photoconductive drum 1 is charged to −800 V. In each environment,an amount of residual toner was measured for a potential difference Vd. The setting of Vd is selected such that the setting linearly increases with increasing detected current.

Then, for a printer in each environment, a set of output voltages of the charging power supply 10 and subsidiary charging power supply 12 was determined, the set of output voltages having the above-determined potential difference Vd and being such that the photoconductive drum is charged to −800. In this manner, a relation between the detected currents and sets of output voltages having varying potential difference Vd was determined. In other words, Lines Sc2 and Ss2 were obtained.

The printer controller 14 of the eighth embodiment determines the output voltages of the charging power supply 10 and subsidiary charging power supply 12 according to the detected current and Lines Sc2 and Ss2 of FIG. 23. Data or a program that describes Lines Sc2 and Ss2 is previously stored in the memory of the printer 14.

Ninth Embodiment

<Construction>

Figure 24:
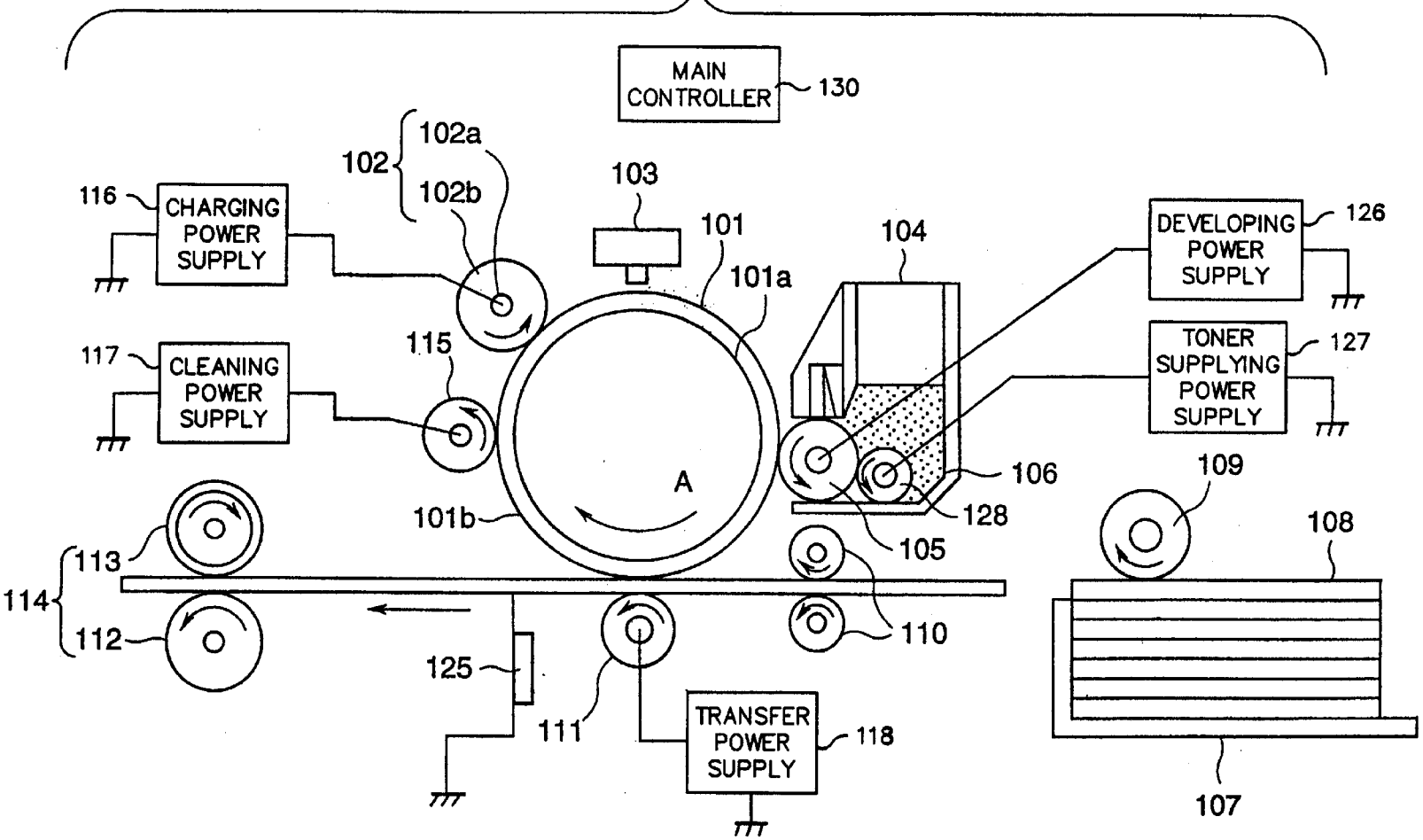
FIG. 24 illustrates a general construction of an image forming apparatus according to a ninth embodiment.

FIG. 24 illustrates a general construction of an image forming apparatus according to a ninth embodiment.

A ninth embodiment is characterized in that when the image forming apparatus is turned on, the conditions (e.g., resistance) of the charging roller 102 are checked before the image forming process, thereby ensuring the stable charging of the photoconductive drum 101 over a long term and irrespective of environmental changes.

In order to implement this feature, the charging power supply 116 is operated in the CCC mode, for example, immediately before the image forming process, and the output voltage is monitored to determine the electrical resistance of the charging roller 102. When the image forming process begins, the charging power supply 116 is switched to the CVC mode. The out put voltages of the charging power supply 116 is set according to a table that lists electrical resistances of the charging roller 102 and corresponding output voltages of the charging power supply 116.

The general construction of the printer according to the ninth embodiment will be described with reference to FIG. 24.

The photoconductive drum 101 is rotated by a drive means, not shown, in a direction shown by arrow A. The photoconductive drum 101 includes a electrically conductive supporting body 101*a* with a photoconductive layer 101*b* formed thereon. The photoconductive layer 101*b* is made of a negatively-charged type organic photoconductive material having a relative dielectric constant of 3.5εo ($\epsilon o = 8.855\times10^{-17}$ C/Vm: dielectric constant in a vacuum) and a thickness of t=18 μm.

The image forming process is the same as that described in the first embodiment with reference to FIG. 1. Thus, detailed description thereof is omitted.

The ninth embodiment employs a reversal type developing method where the photoconductive drum is uniformly charged before an electrostatic latent image is formed thereon, the toner is charged to the same polarity as the charged surface of the photoconductive drum. A bias voltage is applied across the conductive supporting body 101*a* of the photoconductive drum 101 and a toner carrying body or developing roller 105. The bias voltage creates the line of electric force between the developing roller 105 and the photoconductive drum, the line of electric force being configured to mate the specific contour of an electrostatic latent image formed on the photoconductive drum 101. The charged toner 106 on the developing roller 105 is attracted by the Coulomb force to the photoconductive drum 101, thereby developing the electrostatic latent image into a toner image. A toner supplying roller 128 receives a high voltage from a toner supplying power supply 127. The developing roller 105 receives a high voltage from a developing power supply 126.

A feed roller 109 feeds recording paper 108 from a paper cassette 107 to registry rollers 110 which in turn correct the skew of the recording paper 108.

The registry rollers 110 are driven into rotation to advance the recording paper 108 to the transfer unit where the toner image is transferred by a transfer roller 111 from the photoconductive drum 101 to the recording paper 108. The transfer roller 111 is in pressure contact with the photoconductive drum 101 and is driven in rotation in a direction shown by an arrow by the photoconductive drum 101. A transfer power supply 118 applies to the transfer roller 111 a positive voltage of an opposite polarity to the toner image, so that the toner image is transferred from the photoconductive drum 101 to the recording paper 108. After the transferring operation, the recording paper 108 is neutralized by a neutralizing member 125 so that the recording paper 108 is separated from the photoconductive drum 101. Then, the recording paper 108 is advanced to a fixing unit 114 formed of a pressure roller 112 and a heat roller 113. The heat roller 113 generates heat to fuse the toner on the recording paper 108 so that the fused toner penetrates between fibers of the recording paper 108. Then, the recording paper after fixing is discharged from the printer.

Some toner remains deposited on the photoconductive drum 101 after transferring and is removed by a cleaning roller 115 as the photoconductive drum 101 rotates to the cleaning roller 115. In this manner, the photoconductive drum 101 is repeatedly used. The respective members of the image forming apparatus operate at timings generated by the main controller 130.

As mentioned previously, the ninth embodiment is characterized by a method of controlling voltages applied to the charging roller 102. Thus, the ninth embodiment will be described with respect to the features such as the charging power supply 116.

The charging power supply 116 is adapted to be operated in different ways of control and is provided with a function in which the electrical resistance of the charging roller 102 is measured. Specifically, the charging power supply 116 is operated in the CCC mode prior to the image forming process (e.g., power-up of the printer and immediately before image forming process). The charging power supply 116 monitors the output voltage during the CCC mode and determines the resistance of the charging roller 102 on the basis of the monitored voltage. During the image forming process, the charging power supply 116 is operated in the CVC mode where the output voltage of the charging power supply is set in accordance with the resistance of the charging roller 102.

Just like the charging power supply 116 (FIG. 2) of the first embodiment, the charging power supply 116 according to the ninth embodiment is provided with a current detector 116*a*, controller 116*b*, and constant voltage circuit 116*c*. The constant voltage circuit 116*c* is a power supply circuit capable of generating a desired voltage in accordance with an instruction from the controller 116*b*. The output voltage of the constant voltage circuit 116*c* is applied to the charging roller 102 through the current detector 116*a*. The current detector 116*a* detects a current that flows from the constant voltage circuit 116*c* to the charging roller 102.

The controller 116 has a memory, processor, and various driver circuits and controls the constant voltage circuit 116*c*. The processor carries out the control program stored in the memory to perform variety of functions. For example, the controller has a function of a constant voltage control operation (CVC mode) in which a desired voltage is applied to the charging roller 102. The controller has another function, which is an operation in the CCC mode where the charging roller 102 is energized at a desired current. The controller 116 has still another function where the output voltage is monitored in the CCC mode and the electrical resistance of the charging roller 102 is determined on the basis of the monitored output voltage.

The respective functions will be described in detail.

The resistance values of the charging roller 102 and corresponding optimum charging potentials of the charging roller 102 are experimentally determined. The relationship between the resistance values and the optimum charging potentials is tabulated in Tables I–IV (referred to as charging roller resistance tables) stored in the memory. The voltage applied to the charging roller 102 during the image forming process is set by referring to the table.

FIGS. 25A–25D illustrate Tables I–IV, respectively.

It is to be noted that Ohm's law holds between the resistance of the charging roller 102 and the voltage applied across the charging roller 102. Tables I–IV list the resistance values of the charging roller 102 in terms of the voltage applied to the charging roller with a detected current of −15 μA.

Tables I–IV list ranges of average output voltages of the charging power supply 116 when the charging power supply 116 operates in the CCC mode, each of listed voltages being a center value of the voltages in each range. For example, average voltages of 382±39 V fall in the range of "1E". Tables I–IV also lists output voltages when the charging power supply 116 operates in the CVC mode, each of listed output voltages corresponding to the range in the CCC mode. All the voltage in Tables I–IV are negative. The negative voltage is used since the photoconductive drum 101 is of a negatively-charged type. If a positively-charged type photoconductive drum is used, the charging power supply 116 should be designed to apply a positive voltage to the charging roller 102.

Figure 26:
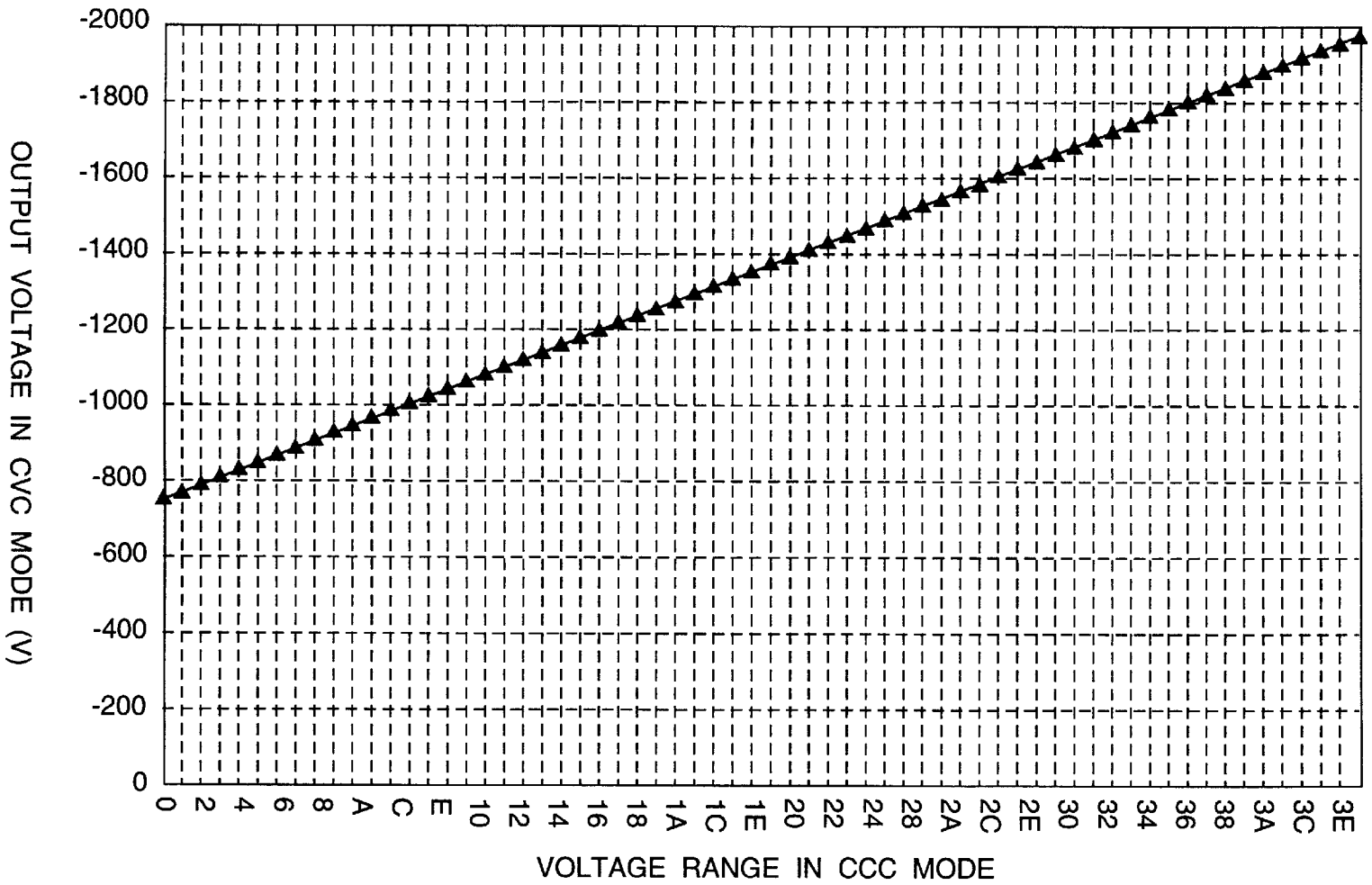
FIG. 26 is a graph showing the relation defined in Tables I–IV.

FIG. 26 is a graph showing the relation defined in Tables I–IV.

The time required for the charging roller 102 to make on complete rotation is determined on the basis of the peripheral speed (m/sec) of the charging roller 102 and the peripheral distance (m) of the charging roller 102.

Figure 27:
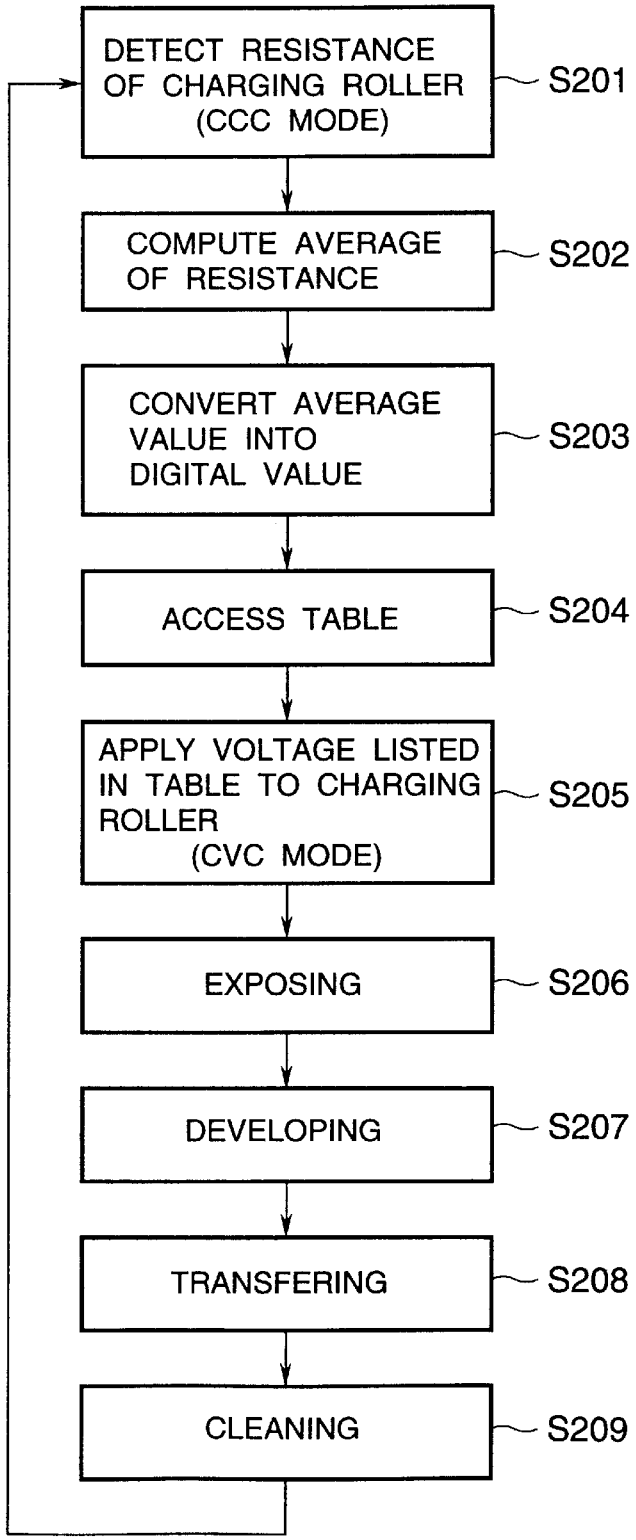
FIG. 27 is a flowchart illustrating the printing operation.

FIG. 27 is a flowchart illustrating the printing operation.

Figure 28:
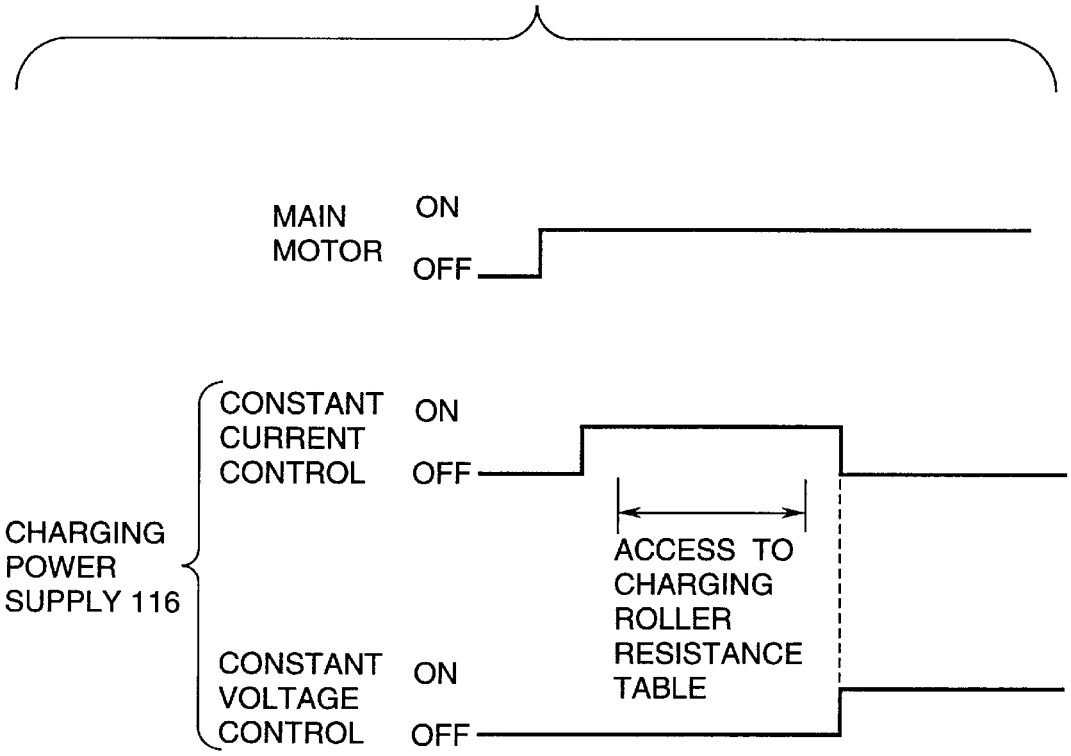
FIG. 28 is a timing chart showing various timings.

FIG. 28 is a timing chart showing various timings.

The operation will be described with reference to FIGS. 23 and 24.

Upon receiving an instruction for image forming process, the main motor is driven in rotation to drive the photoconductive drum 101 into rotation.

As the photoconductive drum 101 rotates, the surface area of the photoconductive drum 101 cleaned by the cleaning roller 115 rotates to the contact region where the charging roller 102 is in contact with the photoconductive drum 101.

Then, while monitoring the output of the current detector 116*a*, the controller 116*b* of the charging power supply 116 energizes the charging roller 102 in the CCC mode, thereby charging the photoconductive drum 101.

During this period, the controller 116*b* monitors the output voltage of the constant voltage circuit 116*c*. The output voltage of the constant voltage circuit 116*c* was measured and recorded. (S201). This voltage measurement is carried out for a length of time corresponding to one complete rotation of the charging roller 102, thereby determining an average value of the voltage for a length of time corresponding to one complete rotation of the charging roller 102 (S202). The average value of the output voltage is converted into a digital value (S203). Then, using the average value of the voltage obtained at step S202, a setting of the output voltage of the charging power supply 116 is determined by referring to Tables I–IV (S204). For example, if an average voltage is 2460±39 V, then Table II shown in FIG. 25B is accessed by "1F" to obtain a setting of output voltage of −1349 V.

Then, the controller 116 enters the CVC mode at a predetermined timing (S205), so that the constant voltage circuit 116*c* operates at a voltage setting determined at step S204 (e.g., −1349 V). Thereafter, the normal image forming process is carried out; exposing (S206), developing (S207), transferring (S208), and cleaning (S208).

According to the ninth embodiment, differences in the charging of the photoconductive drum 101 due to changes in the resistance of the charging roller 102 may be eliminated, so that the photoconductive drum is always uniformly charged to minimize the difference in print density. For image forming apparatuses that operate at high speeds, the ninth embodiment makes it possible to uniformly charge the photoconductive drum 101 over a long term and irrespective of changes in environmental conditions.

The ninth embodiment allows a wider range of the resistance changes of charging roller 102 than the conventional method of controlling the output voltage of the charging power supply, lending itself reducing the manufacturing cost of the charging roller 102.

Since the output voltage of the charging power supply 116 is controlled against the changes in the resistance of the charging roller 102 by using charging roller resistance table (Tables I–IV), the value of detected current may be set at will when the roller resistance is measured in terms of the output voltage in the CCC mode. A smaller current alleviates the load on the charging power supply 116 when the resistance of the charging roller is measured in terms of the output voltage of the charging power supply 116. A non-linear control against the changes in the resistance of the charging roller 102 may also be possible.

Referring again to FIGS. 25A–25D, the resistance values (i.e., in terms of voltages) of the charging roller 102 is grouped in 64 levels, i.e., "00" to "3F". The values may be grouped in other way. For example, if the voltage applied to the charging roller is to be controlled more accurately, then the values are grouped in smaller increments. If the accuracy of voltage is not of prime importance, the values may be grouped in larger increments.

The values shown in FIGS. 25A–25D and 26 are related by a first order equation. However, the values may be related by a second or higher order equation. Even discrete values that lie on a curve may be used.

The charging roller resistance table (Tables I–IV) is accessed by referring to a digital value. However, Tables I–IV may be accessed by referring to other quantity as long as the resistance of the charging roller is referred in terms of output voltage.

Tenth Embodiment

As described in the ninth embodiment, the resistance of the charging roller 102 varies from roller to roller and with environmental changes. The changes in resistance of the charging roller 102 result from, for example, changes in environment, elapsed time, and fluctuation in printing speed. Therefore, applying a constant voltage to the charging roller 102 at all times cannot accurately control the charging of the photoconductive drum 101. This holds true for the toner carrying body or developing roller 105, toner supplying body or sponge roller 128, and cleaning roller 115.

The tenth embodiment is characterized in that after the image forming apparatus is turned on, the resistance of, for example, the developing roller 105 is detected prior to the image forming process, then the voltage to be applied to the roller is controlled in accordance with the detection results. The resistance is detected based on an output voltage of the power supply detected when the power supply is operated in the CCC mode, just as in the eighth embodiment.

The tenth embodiment is of the same construction as the ninth embodiment (FIG. 24) except for the developing power supply 126, toner supplying power supply 127, and cleaning power supply 117. Thus, the tenth embodiment will be described with respect to a configuration different from the ninth embodiment.

Just like the charging power supply 116, the way of controlling the power supplies 126, 127, and 117 can be switched (i.e., between the CCC mode and the CVC mode), and the output voltages are detected in the CCC mode and the resistances of the various rollers are computed on the basis of the detected output voltages. The supplies 126, 127, and 117 are each provided with a table that lists the resistance of the corresponding roller and output voltage applied to the roller.

<Operation>

FIG. 28 is a timing chart showing various timings for the charging power supply.

Figure 29:
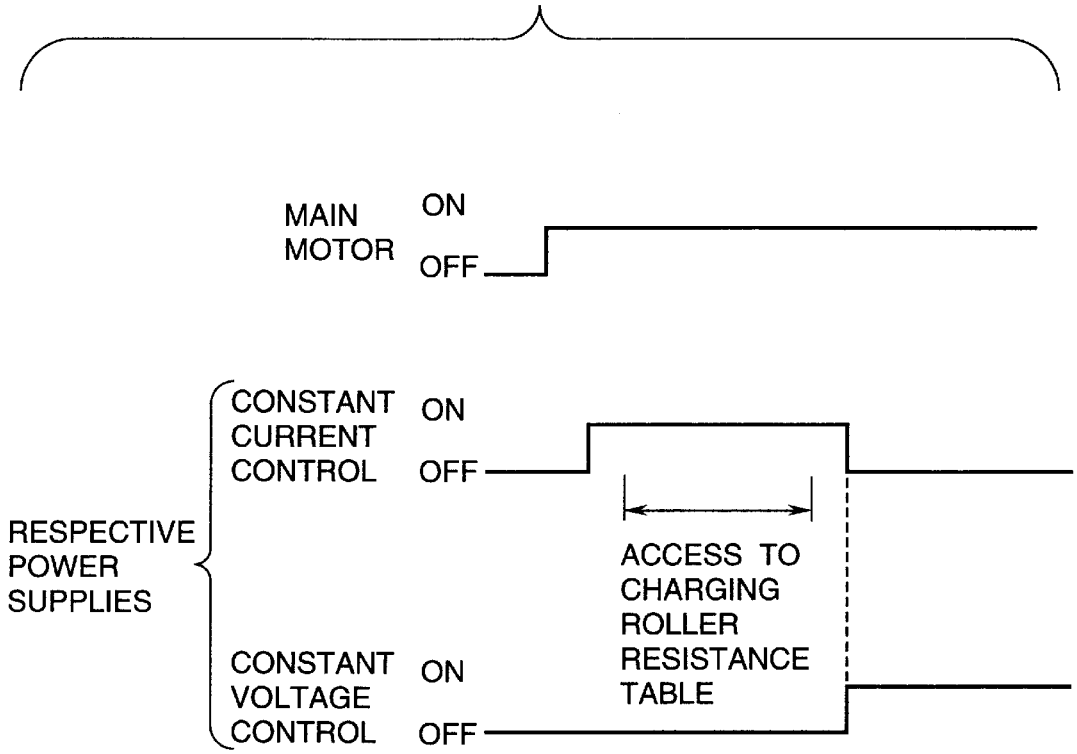
FIG. 29 is a timing chart showing various timing for the respective power supplies.
Figure 30:
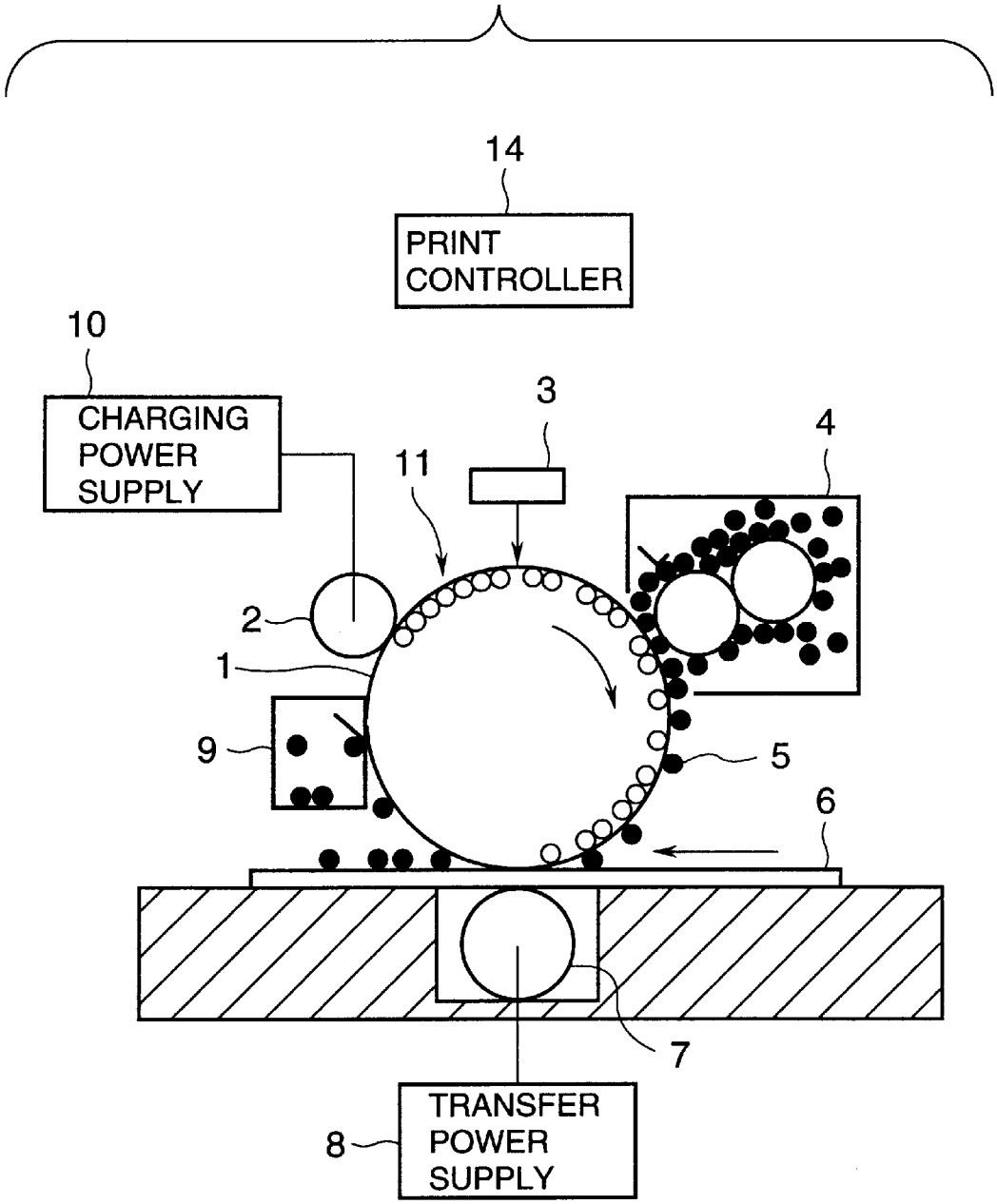
FIG.30 PRIOR ART
FIG. 30 illustrates a general construction of a conventional electrophotographic printer.
Figure 31:
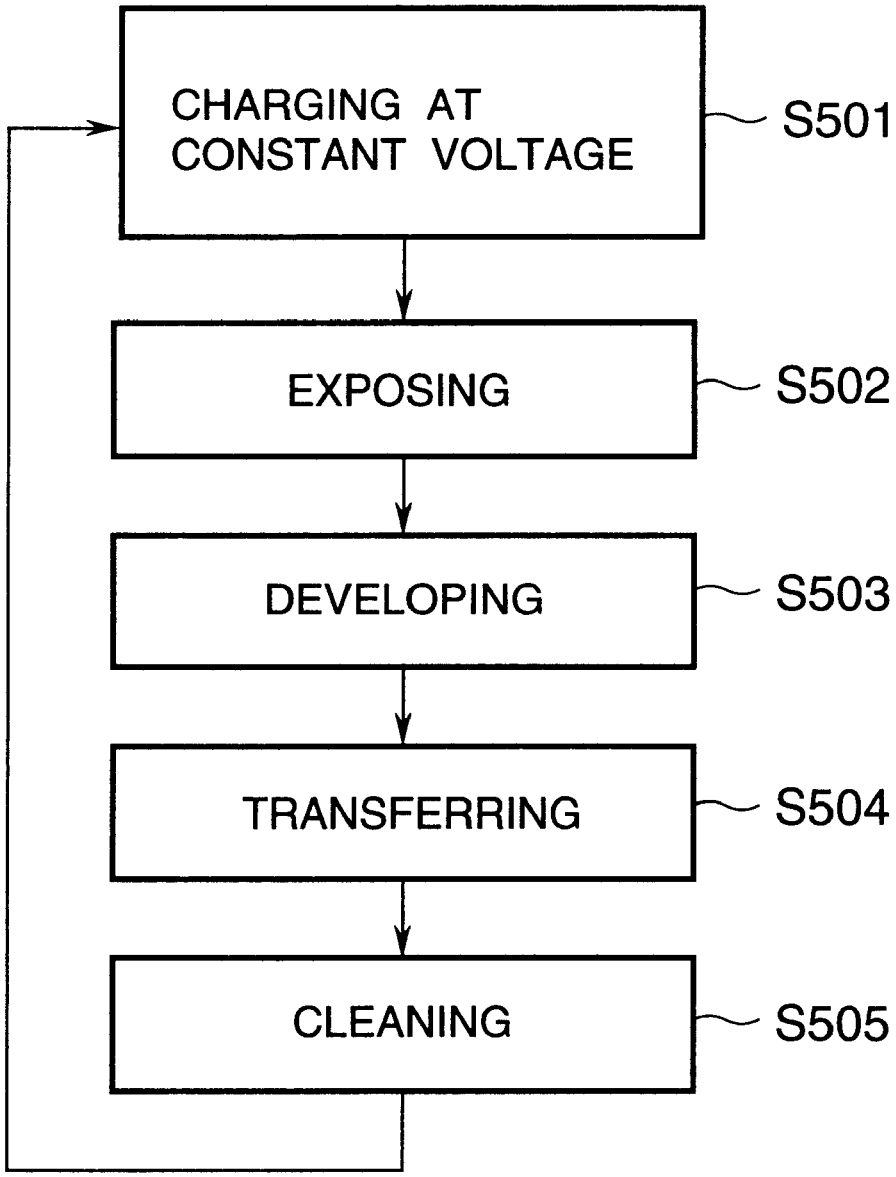
FIG.31 PRIOR ART
FIG. 31 is a flowchart illustrating the outline of a prior art photographic printing operation.
Figure 32:
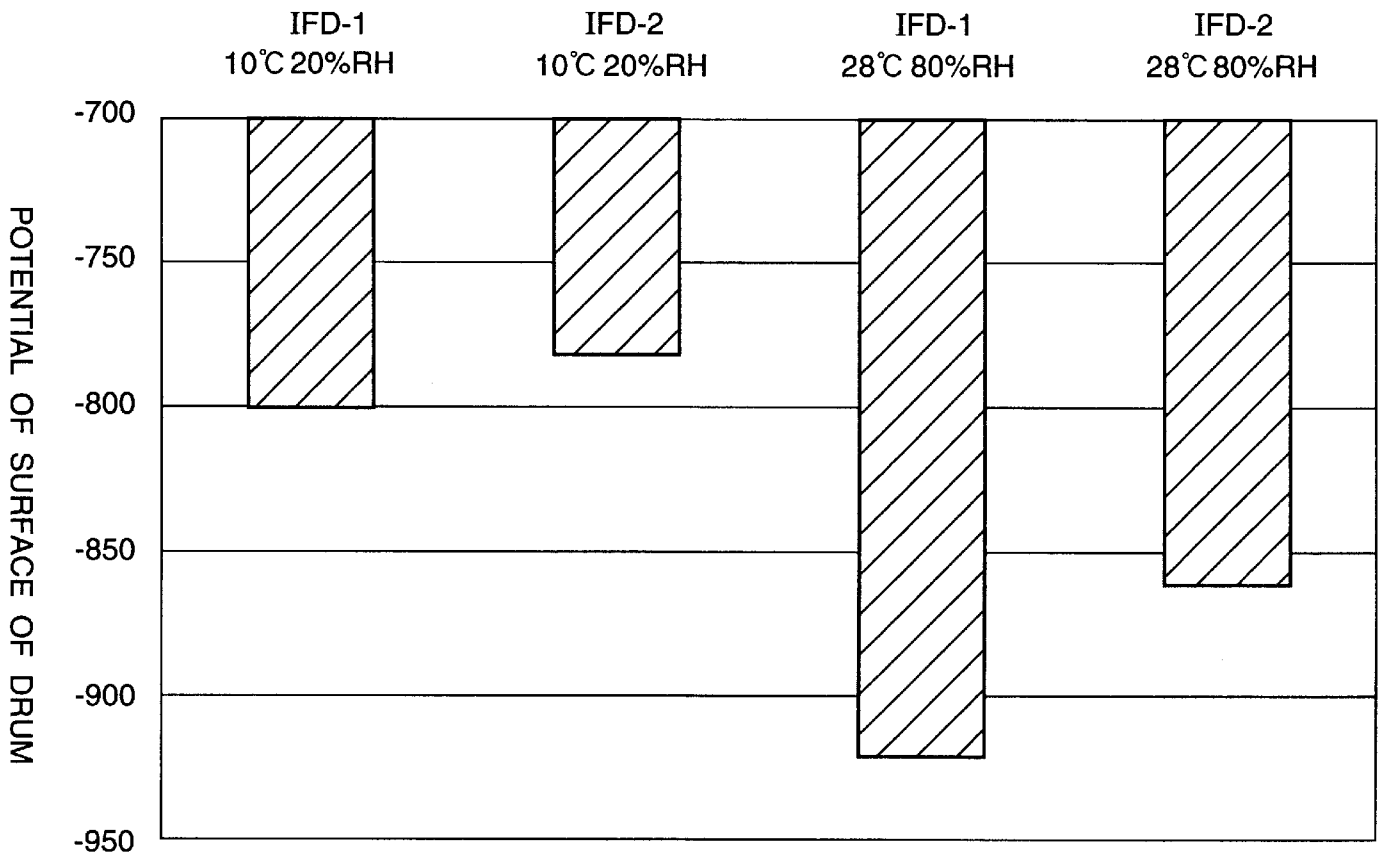
FIG.32 PRIOR ART
FIG. 32 shows the test results.

FIG. 29 is a timing chart showing various timing for the respective power supplies.

The operation of the tenth embodiment will now be described with reference to FIG. 29.

Just as in the ninth embodiment, the power supplies 126, 127, and 117 and the rollers 105, 115, and 128 are energized with a desired current (i.e., CCC mode) after the main motor is driven in rotation. The output voltages of the power supplies 126, 127, and 117 are monitored for a period corresponding to at least one complete rotation of the corresponding rollers, thereby determining average values of the monitored voltages. The Tables I–IV of FIGS. 25A–25D are accessed using the thus determined average values to find output voltages for subsequent operation of the power supplies in the CVC mode. Time required for each roller to make one complete rotation is determined by the rotational speed of the roller and peripheral distance of the roller.

Then, the power supplies 126, 127, and 117 are switched to the CVC mode prior to the normal image forming process. The output voltages of the power supplies 126, 127, and 117 are those obtained from the aforementioned tables.

As mentioned above, the tenth embodiment allows stable recording over a long period of time and irrespective of environmental changes. Further, the tenth embodiment allows a wider range of changes in the resistance of the developing roller 105, sponge roller 128, and cleaning roller 115 than conventional apparatuses, lending itself to reducing the manufacturing costs of the rollers.

The resistances of the rollers can be detected at a desired detected current in the CCC mode. Setting a smaller detected current reduces the load on the power supplies 126, 127, and 117 when the resistances of the corresponding rollers are detected. Since the voltages applied to the rollers during the image forming process are set according to the tables previously prepared, the voltages can be controlled against changes in the resistances of the rollers 105, 115, and 128 which may change non-linearly.

The present invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An electrophotographic image forming apparatus in which an electrostatic latent image is developed with toner into a toner image and the toner image is transferred to a recording medium, the apparatus comprising:

an image bearing body having an electrostatic latent image formed thereon;

a charging member in contact with said image bearing body, said charging member charging said image bearing body when said charging member receives a voltage;

a detector, detecting a characteristic of said charging member when the electrostatic latent image is not being formed and outputting a detection signal indicative of the characteristic;

a charging power supply, applying the voltage to said charging member, the voltage having a value in accordance with the detection signal; and a neutralizing device, neutralizing the charge from said image bearing body before said detector detects the characteristic of said charging member, and not neutralizing the charge from said image bearing body when the electrostatic latent image is being formed.

2. The electrophotographic image forming apparatus according to claim 1, wherein said detector detects an electrical resistance of said charging member.

3. The electrophotographic image forming apparatus according to claim 2, wherein when the electrostatic latent image is not being formed, said detector drives said charging power supply to apply the voltage having a constant value to said charging member;

wherein when said charging power supply applies the voltage having the constant value to said charging member, said detector detects a current supplied to said charging member and outputs the signal reflecting the current.

4. The electrophotographic image forming apparatus according to claim 3, wherein said charging power supply comprises a memory in which a table is stored, the table listing values of the detection signal and corresponding values of the voltage that should be supplied to said charging member;

wherein said charging power supply outputs the voltage according to the table, the voltage having a value corresponding to a value of the detection signal.

5. The electrophotographic image forming apparatus according to claim 2, wherein when the electrostatic latent image is not being formed, said detector drives said charging power supply to supply a constant current to said charging member;

wherein said detector detects the voltage applied to said charging member when the constant current is supplied to said charging member, said detector outputting the detection signal reflecting the voltage.

6. The electrophotographic image forming apparatus according to claim 5, wherein said charging power supply comprises a memory in which a table is stored, the table listing values of the detection signal and corresponding values of the voltage that should be supplied to said charging member;

wherein said charging power supply outputs the voltage according to the table, the voltage having a value corresponding to a value of the detection signal.

7. The electrophotographic image forming apparatus according to claim 1, wherein said neutralizing device starts to neutralize the surface of said image bearing body when said image bearing body starts to rotate;

wherein when a neutralized area on said image bearing body arrives at said charging member, said charging power supply operates in a constant current mode where the voltage is of a value such that a constant current is supplied to said charging member.

8. The electrophotographic image forming apparatus according to claim 1, wherein said neutralizing device starts to neutralize the surface of said image bearing body when said image bearing body starts to rotate;

wherein when said image bearing body starts to rotate, said charging power supply operates in a constant voltage mode where the voltage is of a constant value; and wherein when a neutralized area on said image bearing body arrives at said charging member, said charging power supply operates in a constant current mode where the voltage is of a value such that a constant current is supplied to said charging member.

9. The electrophotographic image forming apparatus according to claim 1 further comprising an exposing unit that illuminates said image bearing body to form the electrostatic latent image on said image bearing body, wherein said exposing unit serves as said neutralizing device.

10. The electrophotographic image forming apparatus according to claim 9, wherein when said exposing unit serves as said neutralizing device, said exposing unit illuminates a surface of said image bearing body in its entirety.

11. An electrophotographic image forming apparatus in which an electrostatic latent image formed on a charged surface of an image bearing body is developed with toner into a toner image and the toner image is transferred to a recording medium, the apparatus comprising:

a charging member, charging said image bearing body;

an exposing unit, illuminating a surface of said charged image bearing body to form an electrostatic latent image on the surface;

a developing unit, applying toner to the electrostatic latent image to develop the electrostatic latent image into a toner image;

a transfer member, transferring the toner image on said image bearing body to the recording medium;

a cleaning member, for removing residual toner remaining on said image bearing body after the toner image has been transferred to the recording medium and for neutralizing the surface of said image bearing body; and a switching device that switches between a first voltage and a second voltage such that said cleaning member receives the first voltage when said cleaning member serves as a neutralizing device to neutralize the surface of said image bearing body and receives the second voltage when the cleaning member serves as a cleaning device to remove residual toner from said image bearing body.

12. The electrophotographic image forming apparatus according to claim 11, wherein the first voltage is an AC voltage and the second voltage is a DC voltage.

13. An electrophotographic image forming apparatus in which an electrostatic latent image formed on a charged surface of an image bearing body is developed with toner into a toner image and the toner image is transferred to a recording medium, the apparatus comprising:

a charging member, charging said image bearing body;

an exposing unit, illuminating a surface of said charged image bearing body to form an electrostatic latent image on the surface;

a developing unit, applying toner to the electrostatic latent image to develop the electrostatic latent image into a toner image;

a transfer member, transferring the toner image on said image bearing body to the recording medium; and a cleaning member, removing residual toner remaining on said image bearing body after the toner image has been transferred to the recording medium;

wherein said transfer member serves as a neutralizing device, said transfer member receiving an a-c voltage to neutralize the surface of said image bearing body.

14. An electrophotographic image forming apparatus in which an electrostatic latent image formed on a charged surface of an electrostatic latent image bearing body is developed with toner into a toner image and the toner image is transferred to a recording medium, the apparatus comprising:

an image bearing body having an electrostatic latent image formed thereon;

a developing member in contact with said image bearing body, said developing member applying toner to said image bearing body when said developing member receives a first voltage;

a first detector, detecting a characteristic of said developing member and outputting a first signal indicative of the characteristic;

a developing power supply, applying the first voltage to said developing member, the first voltage having a value in accordance with the first signal;

a toner supplying member in contact with said developing member and supplying the toner to said developing member;

a second detector, detecting a characteristic of said toner supplying member and outputting a second signal indicative of the characteristic;

a toner supplying power supply, applying a second voltage in accordance with the second signal to said toner supplying member;

a cleaning member in contact with said image bearing body, said cleaning member removing toner remaining on said image bearing body;

a third detector, detecting a characteristic of said cleaning member and outputting a third signal reflecting the characteristic of said cleaning member; and a cleaning power supply, applying a third voltage in accordance with the third signal to said cleaning member.

15. The electrophotographic image forming apparatus according to claim 14, wherein when said developing power supply, said toner supplying power supply, and said cleaning power supply are operated to supply a constant current to said developing member, said toner supplying member, and said cleaning member, respectively, said first to third detectors detect output voltages of said developing power supply, said toner supplying power supply, and said cleaning power supply;

wherein said first to third detectors output the first to third signals reflecting the output voltages.

16. An electrophotographic image forming apparatus in which an electrostatic latent image formed is developed with toner into a toner image and the toner image is transferred to a recording medium, the apparatus comprising:

an image bearing body having an electrostatic latent image formed thereon;

a charging member in contact with said image bearing body, said charging member charging said image bearing body when said charging member receives a first voltage;

a detector, detecting a characteristic of said charging member and outputting a detection signal indicative of the characteristic;

a subsidiary member having a surface in contact with said charging member; and a subsidiary power supply, supplying a second voltage to said subsidiary member;

wherein the first voltage and the second voltage are determined in accordance with the detection signal outputted from said detector.

17. The electrophotographic image forming apparatus according to claim 16, wherein said charging member is a charging roller;

wherein said subsidiary member is a subsidiary roller having a roller surface in contact with the charging roller, said subsidiary roller having an electrically conductive surface and being driven by said charging roller when the charging roller rotates; and wherein the subsidiary power supply applies the second voltage to said subsidiary roller, the second voltage being of substantially the same value as the first voltage and being applied at substantially the same timing as the first voltage.

18. The electrophotographic image forming apparatus according to claim 16, wherein the charging member is a charging roller;

wherein said subsidiary member has an electrically conductive surface and is driven by said charging roller when the charging roller rotates; and the second voltage has a larger absolute value than the first voltage and is applied at substantially the same timing as the first voltage.

19. The electrophotographic image forming apparatus according to claim 18, wherein said subsidiary power supply applies the second voltage to the subsidiary member, such that the second voltage differs from the first voltage by a predetermined voltage value.

20. The electrophotographic image forming apparatus according to claim 18, wherein said subsidiary power supply applies the second voltage to the subsidiary member such that the second voltage differs from the first voltage in accordance with the detection signal.

* * * * *